US011489259B2

(12) United States Patent
Mitchelson et al.

(10) Patent No.: US 11,489,259 B2
(45) Date of Patent: Nov. 1, 2022

(54) DUAL-BAND PARABOLIC REFLECTOR MICROWAVE ANTENNA SYSTEMS

(71) Applicant: CommScope Technologies LLC, Hickory, NC (US)

(72) Inventors: Craig Mitchelson, Cumbernauld (GB); Douglas John Cole, Powmill (GB); Claudio Biancotto, Edinburgh (GB); Lawrence Bissett, Leven (GB)

(73) Assignee: COMMSCOPE TECHNOLOGIES LLC, Hickory, NC (US)

( * ) Notice: Subject to any disclaimer, the term of this patent is extended or adjusted under 35 U.S.C. 154(b) by 825 days.

(21) Appl. No.: 16/311,104

(22) PCT Filed: Sep. 22, 2017

(86) PCT No.: PCT/US2017/052848
§ 371 (c)(1),
(2) Date: Dec. 18, 2018

(87) PCT Pub. No.: WO2018/057824
PCT Pub. Date: Mar. 29, 2018

(65) Prior Publication Data

US 2020/0313296 A1 Oct. 1, 2020

Related U.S. Application Data

(60) Provisional application No. 62/398,598, filed on Sep. 23, 2016.

(51) Int. Cl.
*H01Q 5/47* (2015.01)
*H01Q 15/16* (2006.01)
(Continued)

(52) U.S. Cl.
CPC ..... *H01Q 5/47* (2015.01); *H01Q 13/025* (2013.01); *H01Q 15/16* (2013.01);
(Continued)

(58) Field of Classification Search
CPC ..... H01Q 5/47
See application file for complete search history.

(56) References Cited

U.S. PATENT DOCUMENTS 4,797,681 A * 1/1989 Kaplan ..... H01Q 13/0258 333/137
4,819,005 A * 4/1989 Wilkes ..... H01Q 5/47 343/786
(Continued)

FOREIGN PATENT DOCUMENTS

CN 1337077 A 2/2002
CN 1886863 A 12/2006
(Continued)

OTHER PUBLICATIONS

Extended European Search Report for corresponding EP Application No. 17853948.2, dated Mar. 18, 2020, 8 pgs.
(Continued)

*Primary Examiner* — Ab Salam Alkassim, Jr.
(74) *Attorney, Agent, or Firm* — Myers Bigel, P.A.

(57) ABSTRACT

Microwave antenna systems include a parabolic reflector antenna and a dual-band feed assembly. The dual-band feed assembly includes a coaxial waveguide structure and a sub-reflector. The coaxial waveguide structure includes a central waveguide and an outer waveguide that circumferentially surrounds the central waveguide. The sub-reflector is mounted proximate the distal end of the coaxial waveguide structure.

17 Claims, 14 Drawing Sheets

(51) Int. Cl.
*H01Q 19/19* (2006.01)
*H01Q 13/02* (2006.01)
*H01Q 19/02* (2006.01)

(52) U.S. Cl.
CPC ..... *H01Q 19/193* (2013.01); *H01Q 13/0258* (2013.01); *H01Q 19/026* (2013.01)

(56) References Cited

U.S. PATENT DOCUMENTS 4,963,878 A 10/1990 Kildal
5,107,274 A * 4/1992 Mitchell ..... H01P 1/165 333/135
5,162,808 A 11/1992 Kim
5,617,108 A * 4/1997 Silinsky ..... H01Q 13/025 333/135
5,635,944 A * 6/1997 Weinstein ..... H01P 1/2133 333/135
5,793,335 A * 8/1998 Anderson ..... H01Q 13/02 333/126
6,031,434 A * 2/2000 Tatomir ..... H01P 1/2131 333/135
6,081,170 A * 6/2000 Enokuma ..... H01Q 5/47 333/21 A
6,137,449 A 10/2000 Kildal
6,452,561 B1 * 9/2002 West ..... H01Q 13/0258 343/786
6,496,084 B1 * 12/2002 Monte ..... H01P 1/161 333/121
6,720,932 B1 * 4/2004 Flynn ..... H01P 1/213 333/21 A
7,180,459 B2 * 2/2007 Balaji ..... H01Q 13/025 343/786
8,089,415 B1 * 1/2012 West ..... H01Q 5/55 343/777
8,230,581 B1 * 7/2012 Wilcoxon ..... H01Q 5/47 29/600
8,786,508 B1 * 7/2014 Edwards ..... H01Q 5/47 343/786
9,105,952 B2 * 8/2015 Hoover ..... H01Q 5/47
2001/0011933 A1 8/2001 Enokuma
2002/0097111 A1 7/2002 Holden et al.
2002/0149532 A1 * 10/2002 Wu ..... H01Q 5/40 343/786
2003/0222733 A1 * 12/2003 Ergene ..... H01Q 25/02 333/125
2004/0041737 A1 * 3/2004 Gothard ..... H01Q 19/191 343/781 P
2004/0257290 A1 * 12/2004 Gothard ..... H01Q 19/19 343/781 CA
2005/0017916 A1 1/2005 Lewry et al.
2005/0083241 A1 * 4/2005 Zarro ..... H01Q 13/025 343/786
2005/0088355 A1 * 4/2005 Kralovec ..... H01Q 13/0208 343/781 P
2005/0099350 A1 * 5/2005 Gothard ..... H01Q 19/193 343/781 CA
2005/0099351 A1 * 5/2005 Gothard ..... H01Q 15/0033 343/781 CA
2005/0104794 A1 * 5/2005 Rao ..... H01Q 13/0258 343/781 R
2011/0181479 A1 * 7/2011 Martin ..... H01Q 13/025 343/756
2012/0007792 A1 * 1/2012 Brandau ..... H01Q 1/00 343/907
2012/0025848 A1 * 2/2012 Hasch ..... B23D 59/005 324/640
2014/0247191 A1 * 9/2014 Mahon ..... H01Q 19/191 343/781 CA
2014/0368408 A1 * 12/2014 Tuau ..... H01Q 19/134 343/914
2015/0084821 A1 * 3/2015 Rao ..... H01Q 19/193 343/781 CA
2015/0097747 A1 * 4/2015 Hwang ..... H01Q 13/0258 343/785
2016/0049733 A1 * 2/2016 Dunning ..... H01Q 13/0258 343/756
2016/0126638 A1 * 5/2016 Brandau ..... H01Q 19/134 343/781 CA
2016/0134004 A1 * 5/2016 Haluba ..... H04W 88/06 455/12.1
2017/0207541 A1 * 7/2017 Wu ..... H01Q 5/55
2019/0013587 A1 * 1/2019 Gendron ..... H01P 1/172
2019/0020112 A1 * 1/2019 Luo ..... H01Q 19/19
2019/0207321 A1 * 7/2019 Hollenbeck ..... H01Q 5/47
2019/0288394 A1 * 9/2019 Saraf ..... H01Q 5/335
2020/0280135 A1 * 9/2020 Biancotto ..... H01Q 19/06
2021/0126376 A1 * 4/2021 Tuau ..... H01Q 15/165

FOREIGN PATENT DOCUMENTS

CN 201285802 Y 8/2009
CN 104167612 A 11/2014
EP 1004151 5/2000
WO 99/10950 3/1999

OTHER PUBLICATIONS

International Search Report and Written Opinion of the International Searching Authority, International Application No. PCT/US2017/052848, dated Jan. 11, 2018.
Chinese Office Action corresponding to Chinese Application No. 201780045829.5, dated May 12, 2020.

* cited by examiner

DUAL-BAND PARABOLIC REFLECTOR MICROWAVE ANTENNA SYSTEMS

CROSS-REFERENCE TO RELATED APPLICATION

The present application is a 35 U.S.C. 0 371 national stage application of PCT Application No. PCT/US2017/052848, filed on Sep. 22, 2017, which itself claims priority to U.S. Provisional Patent Application Ser. No. 62/398,598, filed Sep. 23, 2016, the entire contents of both of which are incorporated herein by reference as if set forth in their entirety. The above-referenced PCT Application was published in the English language as International Publication No. WO 2018/057824 on Mar. 29, 2018.

BACKGROUND

The present invention relates generally to microwave communications and, more particularly, to antenna systems used in microwave communications systems.

Microwave transmission refers to the transmission of information or energy by electromagnetic waves whose wavelengths are measured in units of centimeters. These electromagnetic waves are called microwaves. The "microwave" portion of the radio spectrum ranges across a frequency band of approximately 1.0 GHz to approximately 300 GHz. These frequencies correspond to wavelengths n a range of approximately 30 centimeters to 0.1 centimeters.

Microwave communication systems may be used for point-to-point communications because the small wavelength of the electromagnetic waves may allow relatively small sized antennas to direct the electromagnetic waves into narrow beams, which may be pointed directly at a receiving antenna. This ability to form narrow antenna beams may allow nearby microwave communications equipment to use the same frequencies without interfering with each other as lower frequency electromagnetic wave systems may do. In addition, the high frequency of microwaves may give the microwave band a relatively large capacity for carrying information, as the microwave band has a bandwidth approximately thirty times the bandwidth of the entirety of the radio spectrum that is at frequencies below the microwave band. Microwave communications systems, however, are limited to line of sight propagation as the electromagnetic waves cannot pass around hills, mountains, structures, or other obstacles in the way that lower frequency radio waves can.

Parabolic reflector antennas are often used to transmit and receive microwave signals. FIG. 1 is a partially-exploded, rear perspective view of a conventional microwave antenna system 10 that uses a parabolic reflector antenna. As shown in FIG. 1, the antenna system 10 includes a parabolic reflector antenna 20, a feed assembly 30 and a hub 50. The parabolic reflector antenna 20 may comprise, for example, a dish-shaped structure that is formed of metal or that has a metal inner surface (the inner metal surface of antenna 20 is not visible in FIG. 1). The hub 50 may be used to mount the parabolic reflector antenna 20 on a mounting structure (not shown) such as a pole, antenna tower, building or the like. The hub 50 may be mounted on the rear surface of the parabolic reflector antenna 20 by, for example, mounting screws. The hub 50 may include a hub adapter 52. A transition element 54 may be received within the hub adapter 52. The transition element 54 may be designed to efficiently launch RF signals received from, for example, a radio (not shown) into the feed assembly 30. The transition element 54 may comprise, for example, a rectangular-to-circular waveguide transition that is impedance matched for a specific frequency band.

An opening or bore 22 is provided at the middle (bottom) of the dish-shaped antenna 20. The hub adapter 52 may be received within this bore 22. The transition element 54 includes a bore 56 that receives the feed assembly 30. The feed assembly 30 may comprise, for example, a circular waveguide 32 and a sub-reflector 40. The circular waveguide 32 may have a tubular shape and may be formed of a metal such as, for example, aluminum. When the feed assembly 30 is mounted in the hub adapter 52 and the hub adapter 52 is received within the bore 22, a base of the circular waveguide 32 may be proximate the bore 22, and a distal end of the circular waveguide 32 and the sub-reflector 40 may be in the interior of the parabolic reflector antenna 20. A low-loss dielectric block 34 may be inserted into the distal end of the circular waveguide 32. A distal end of the low-loss dielectric block 34 may have, for example, a stepped generally cone-like shape. The sub-reflector 40 may be mounted on the distal end of the dielectric block 34. In some cases, the sub-reflector 40 may be a metal layer that is sprayed, brushed, plated or otherwise formed on a surface of the dielectric block 34. In other cases, the sub-reflector 40 may comprise a separate element that is attached to the dielectric block 34. The sub-reflector 40 is typically made of metal and is positioned at a focal point of the parabolic reflector antenna 20. The sub-reflector 40 is designed to reflect microwave energy emitted from the circular waveguide 32 onto the interior of the parabolic reflector antenna 20, and to reflect and focus microwave energy that is incident on the parabolic reflector antenna 20 into the distal end of the circular waveguide 32.

Microwave antenna systems have been provided that operate in multiple frequency bands. For example, the UMX® microwave antenna systems sold by CommScope, Inc. of Hickory, N.C. operate in two separate microwave frequency bands. These antennas include multiple waveguide feeds, each of which directly illuminates a parabolic reflector antenna. Other dual-band designs have been proposed where a first feed directly illuminates a parabolic reflector antenna and a second feed illuminates the parabolic reflector antenna via a sub-reflector. U.S. Pat. No. 6,137,449 also discloses a dual-band reflector antenna design that includes a coaxial waveguide structure.

SUMMARY

Pursuant to embodiments of the present invention, microwave antenna systems are provided that include a parabolic reflector antenna and a dual-band feed assembly that includes a coaxial waveguide structure and a sub-reflector. The coaxial waveguide structure includes a central waveguide and an outer waveguide that circumferentially surrounds the central waveguide. The sub-reflector is mounted proximate the distal end of the coaxial waveguide structure.

In some embodiments, the sub-reflector is configured to direct microwave signals incident on the parabolic reflector antenna into both the central waveguide and the outer waveguide. These microwave signals may include signals in a first, low frequency band and/or signals that are in a second, high frequency band. The center frequency of the high frequency band may be at least 1.4 times, 1.6 times, two times or even three times the center frequency of the, low frequency band.

In some embodiments, the microwave antenna system may include a low pass filter. The low pass filter may be, for example, within the outer waveguide. In an example embodiment, the low pass filter may include a plurality of annular ridges that extend from an outer surface of the central waveguide into the interior of the outer waveguide.

In some embodiments, the feed assembly may include a dielectric support that extends from the distal end of the coaxial waveguide structure. The sub-reflector may be mounted on the dielectric support. In some of these embodiments, the sub-reflector includes a plurality of concentric inner choke rings and/or a plurality of concentric outer choke rings. The outer choke rings may surround the inner choke rings and may be larger than the inner choke rings. In some embodiments, the sub-reflector may be a multi-piece sub-reflector. In such embodiments, the concentric inner choke rings may be part of a first piece of the multi-piece sub-reflector and the concentric outer choke rings may be part of a second piece of the multi-piece sub-reflector.

In some embodiments, the feed assembly includes a dielectric feed that extends from a distal end of the central waveguide and a corrugated feed that extends from and circumferentially surrounds a distal end of the outer waveguide. The corrugated feed may include a plurality of corrugations. In some embodiments, the corrugations may have a stepped profile.

In some embodiments, the sub-reflector may be mounted using a support separate from the coaxial waveguide structure and may be separated from the distal end of the central. In some embodiments, the microwave antenna system may include a feed assembly interface that includes a power divider having at least first and second outputs that are coupled to the outer waveguide. The power divider may be, for example, a Magic T power divider, and the first and second outputs of the power divider may be coupled to opposite sides of the outer waveguide. Each of the first and second outputs of the power divider may comprise a stepped channel that has decreasing cross-sectional area as the respective first and second outputs approach the outer waveguide in example embodiments.

In some embodiments, the microwave antenna system may further include a second feed assembly interface that includes a second power divider having third and fourth outputs that are coupled to the outer waveguide. In such embodiments, each of the first through fourth outputs may be coupled to respective first through fourth locations on the outer waveguide, each of the first through fourth locations or the outer waveguide may be spaced apart from adjacent ones of the first through fourth locations by about ninety degrees. Additionally, the first and second feed assembly interfaces may be offset from each other in a longitudinal direction of the outer waveguide.

In still other embodiments, the microwave antenna system may further include a feed assembly interface that has a first rectangular waveguide and a second rectangular waveguide that are each coupled to the outer waveguide at respective first and second longitudinal positions along the outer waveguide and are each configured to feed microwave signals into the outer waveguide. The feed assembly interface in these embodiments may include at least one shorting element disposed between the first and second longitudinal positions. Each of the first and second rectangular waveguides may include a stepped channel that has decreasing cross-sectional area. A polarization rotator may be disposed in the outer waveguide. In an example embodiment, the polarization rotator may be at least one pin that is angled at a 45 degree angle with respect to a horizontal plane defined by the bottom of the first rectangular waveguide.

In some embodiments, the outer waveguide may comprise a multi-piece outer waveguide, and the low pass filter may comprise a separate structure that is connected to a longer portion of the outer waveguide.

In some embodiments, the low pass filter may comprise a plurality of radially-inwardly extending ribs on an inner surface of the outer waveguide.

In some embodiments, the microwave antenna system may further include a dielectric lens that is mounted on the coaxial waveguide structure. The dielectric lens may comprise, for example, an annular disk with at least one groove therein. The dielectric lens may be configured to focus some microwave energy that passes from the sub-reflector to the parabolic reflector antenna and to scatter other of the microwave energy that passes from the sub-reflector to the parabolic reflector antenna.

In some embodiments, the microwave antenna system may further include a coaxial spacer that is within the coaxial waveguide structure. The coaxial spacer may be positioned between an outer surface of the central waveguide and an inner surface of the outer waveguide. The coaxial spacer may seal a distal end of the outer waveguide in some embodiments.

Pursuant to further embodiments of the present invention, microwave antenna systems are provided that include a parabolic reflector antenna, a feed assembly that includes a waveguide structure, and a feed assembly interface that includes a power divider having at least first and second outputs that are coupled to the waveguide structure.

In some embodiments, the power divider may be a Magic T power divider, and the first and second outputs of the power divider may be coupled to opposite sides of the waveguide structure. Each of the first and second outputs may be a stepped channel that has decreasing cross-sectional area as the respective first and second outputs approach the waveguide.

In some embodiments, the feed assembly may be a dual-band feed assembly, and the waveguide structure may be a coaxial waveguide structure that includes an outer waveguide and a central waveguide that is circumferentially surrounded by the outer waveguide.

The microwave antenna system may farther include a rectangular to circular waveguide transition that is coupled to a base of the central waveguide.

In some embodiments, a sub-reflector may be mounted proximate the distal end of the coaxial waveguide structure. The sub-reflector may be configured to direct microwave signals incident on the parabolic reflector antenna into both the central waveguide and the outer waveguide. The dual-band feed assembly may include a low pass filter within the outer waveguide. The low pass filter may comprise, for example, a plurality of annular ridges that extend from an outer surface of the central waveguide into the interior of the outer waveguide.

In some embodiments, the feed assembly may include a dielectric support that extends from a distal end of the coaxial waveguide structure. The sub-reflector may be mounted on the dielectric support in some embodiments. The sub-reflector may include a plurality of concentric inner choke rings and/or a plurality of concentric outer choke rings. The outer choke rings may surround the inner choke rings and/or the outer choke rings may be larger than the inner choke rings.

In some embodiments, the feed assembly may include a dielectric feed that extends from a distal end of central waveguide and a corrugated feed that extends from and circumferentially surrounds a distal end of the outer waveguide. A plurality of corrugations of the corrugated feed may have a stepped profile. The sub-reflector may be mounted using a support separate from the coaxial waveguide structure and is separated from the distal end of the coaxial waveguide structure by a gap. The microwave antenna system may further include a second feed assembly interface that includes a second power divider having third and fourth outputs that are coupled to the outer waveguide. In such embodiments, each of the first through fourth outputs may be coupled to respective first through fourth locations on the outer waveguide, and each of the first through fourth locations on the outer waveguide being spaced apart from adjacent ones of the first through fourth locations by about ninety degrees. The first and second feed assembly interfaces may be offset from each other in a longitudinal direction of the outer waveguide.

Pursuant to still further embodiments of the present invention, microwave antenna systems are provided that include a parabolic reflector antenna, a feed assembly that includes a waveguide structure that extends in a longitudinal direction, and a feed assembly interface that includes a first rectangular waveguide and a second rectangular waveguide that are each coupled to the waveguide structure at respective first and second longitudinal positions along the waveguide structure.

In some embodiments, the feed assembly interface may further include at least one shorting element disposed between the first and second longitudinal positions.

In some embodiments, each of the first and second rectangular waveguides may include a stepped channel that has decreasing cross-sectional area.

In some embodiments, the feed assembly may comprise a dual-band feed assembly, and the waveguide structure may comprises a coaxial waveguide structure that includes an outer waveguide and a central waveguide that is circumferentially surrounded by the outer waveguide, and the feed assembly interface may further include a polarization rotator that is disposed in the outer waveguide.

In some embodiments, the polarization rotator may comprise at least one pin that is angled at a 45 degree angle with respect to a horizontal plane defined by the bottom of the first rectangular waveguide.

In some embodiments, the microwave antenna system further includes a rectangular to circular waveguide transition that is coupled to a base of the central waveguide.

In some embodiments, the microwave antenna system further includes a sub-reflector mounted proximate the distal end of the coaxial waveguide structure. The sub-reflector may be configured to direct microwave signals incident on the parabolic reflector antenna into both the central waveguide and the outer waveguide.

In some embodiments, the dual-band feed assembly may further include a low pass filter within the outer waveguide. The low pass filter may comprise a plurality of annular ridges that extend from an outer surface of the central waveguide into the interior of the outer waveguide.

In some embodiments, the feed assembly may include a dielectric support that extends from a distal end of the coaxial waveguide structure, and the sub-reflector may be mounted on the dielectric support.

In some embodiments, the sub-reflector may includes a plurality of concentric inner choke rings and/or a plurality of concentric outer choke rings. The outer choke rings may surround the inner choke rings and/or may be larger than the inner choke rings.

In some embodiments, the feed assembly may include a dielectric feed that extends from a distal end of central waveguide and a corrugated feed that extends from and circumferentially surrounds a distal end of the outer waveguide. A plurality of corrugations of the corrugated feed may have a stepped profile.

DESCRIPTION OF THE DRAWINGS

FIG. 5F is a cross-sectional perspective. view of a portion of a microwave antenna system in which the feed assembly interface of FIGS. 5A-5E may be used.

DETAILED DESCRIPTION

Figure 1:
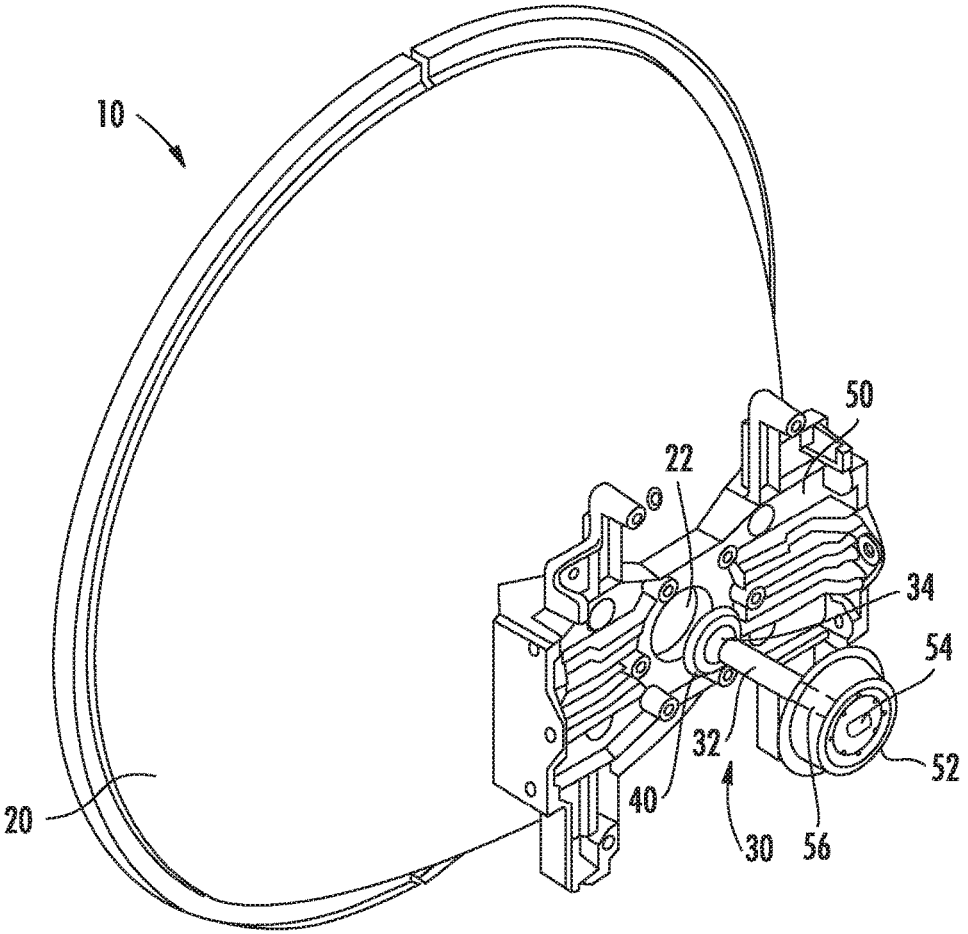
FIG. 1 is a partially-exploded, rear perspective view of a conventional microwave antenna system.

The feed assembly may be an important component of any microwave antenna system. The feed assembly of a microwave antenna system receives a microwave signal from a radio and should be designed to efficiently radiate this microwave signal onto, for example, a parabolic reflector antenna to produce a highly-focused pencil beam of microwave energy that propagates in a single direction. The feed assembly likewise collects microwave energy that is incident on the parabolic reflector antenna and focused by the parabolic reflector antenna to a focal point when operating in a receive mode, and directs this microwave energy into a waveguide or other feed structure for provision to the receive port of a radio.

Microwave antenna system feed assemblies are complex structures. As described above, typically these feed assemblies include, among other things, a waveguide, a low-loss dielectric block and a sub-reflector, which may be a metallized surface on the dielectric block. The low-loss dielectric block may be machined from a rod of material or injection molded. The shape and size of these dielectric blocks (and associated sub-reflector) may vary widely, and may be dependent on, among other things, the frequency of operation, the shape of the parabolic reflector antenna, the presence or absence of an RF shield and various other factors. When the sub-reflector is formed by metallizing a distal end of the low-loss dielectric block, the sub-reflector may be applied by a variety of methods including, for example, spaying, brushing, taping or plating.

Microwave antenna systems are typically required to perform within very stringent operating conditions, both to meet capacity requirements and to avoid excessive interference with nearby microwave antenna systems. As a result, microwave antenna system feed assemblies typically have not been implemented as wide bandwidth devices, with a typical feed assembly supporting a transmission/reception bandwidth that is no more than about 20% of a frequency midway between the center frequencies of the transmit and receive bands for the microwave antenna system. Since the microwave frequency bands that are in commercial use are fairly widely separated in frequency (e.g., commercial microwave frequency bands are at about 4 GHz to 80 GHz), conventional microwave feed assemblies only support one distinct microwave band (separate channels within a band can be dedicated to transmit or receive).

Pursuant to embodiments of the present invention, microwave antenna systems are provided that include a parabolic reflector antenna and a dual-band feed assembly. The dual-band feed assembly can support transmission and reception in two distinct microwave frequency bands. The dual-band feed assembly includes a coaxial waveguide structure and a sub-reflector. The coaxial waveguide structure includes a central waveguide and an outer waveguide that circumferentially surrounds the central waveguide. The sub-reflector is mounted proximate the distal end of the coaxial waveguide structure. The sub-reflector may be configured to direct microwave signals between the parabolic reflector antenna and the coaxial waveguide structure. The signals in the higher frequency of the two frequency bands (the "high-band") may be fed to the parabolic reflector antenna through the central waveguide, and the signals in the lower frequency of the two frequency bands (the "low-band") may be fed to the parabolic reflector antenna through the outer waveguide. The central waveguide may have a circular transverse cross-section and the outer waveguide may have a generally annular transverse cross-section.

In some embodiments, a low pass filter may be formed within the outer waveguide. The low pass filter may comprise, for example, a plurality of annular ridges that extend from an outer surface of the central waveguide into the interior of the outer waveguide. The feed assembly may include a dielectric support that extends from the distal end of the coaxial waveguide structure. The sub-reflector may be mounted on the dielectric support in some embodiments.

In some embodiments, the feed assembly may comprise a dual-band hat feed assembly. In such embodiments, the sub-reflector may include a plurality of concentric inner choke rings and a plurality of concentric outer choke rings that surround the inner choke rings, where the outer choke rings are larger than the inner choke rings. In other embodiments, the dual-band feed assembly may comprise a dielectric feed that extends from a distal end of the central waveguide and a corrugated feed that extends from and circumferentially surrounds a distal end of the outer waveguide. The corrugated feed may include a plurality of corrugations that have a stepped profile. The sub-reflector may be mounted using a support separate from the coaxial waveguide structure and may be separated from the distal end of the central waveguide by a gap.

The microwave antenna systems according to embodiments of the present invention may also include one or more feed assembly interfaces. For example, in some embodiments, a feed assembly interface in the form of a rectangular-to-circular waveguide transition may be provided between a high-band radio and the central waveguide of the coaxial feed assembly. A feed assembly interface in the form of a power divider may also be provided between a low-band radio and the outer waveguide of the coaxial feed assembly. First and second outputs of the power divider may be coupled to opposite sides of the outer waveguide which each couple a low-band signal onto approximately half of the circumference of the annular outer waveguide.

The present invention will now be discussed in further detail with respect to FIGS. 2-8C, which illustrate example embodiments of the present invention.

Figure 2:
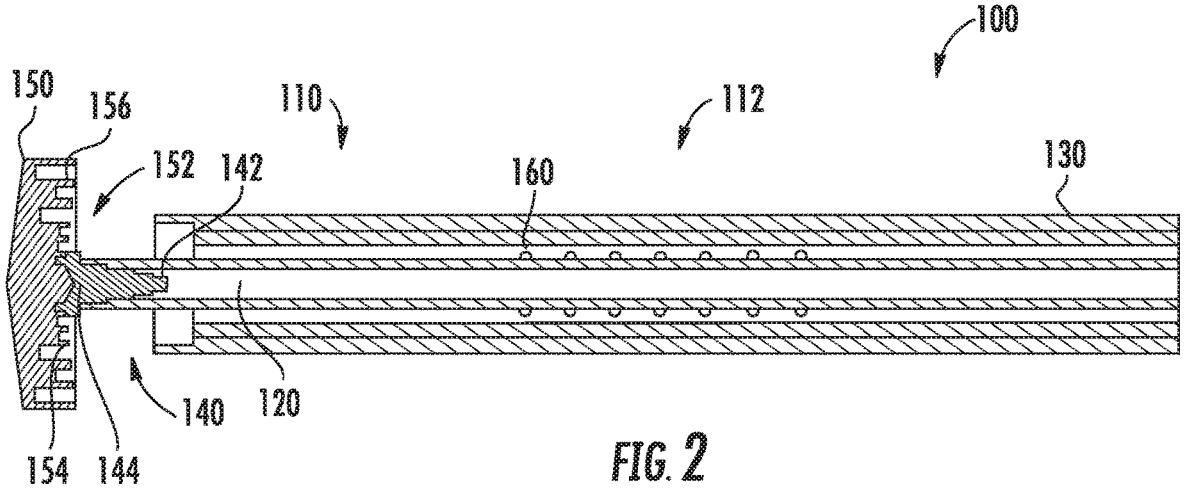
FIG. 2 is a side sectional view of a coaxial hat feed assembly according to certain embodiments of the present invention.

FIG. 2 is a cross-sectional view of a dual-band coaxial hat feed assembly 100 according to embodiments of the present invention. The dual-band coaxial hat feed assembly 100 may be, for example, used in the microwave antenna system 10 of FIG. 1 in place of the conventional feed assembly 30.

As shown in FIG. 2, the dual-band coaxial hat feed assembly 100 includes a sub-reflector 150 and a feed section 110 that has a coaxial waveguide structure 112. The coaxial waveguide structure 112 includes an inner or "central" waveguide 120, an outer waveguide 130 and a dielectric support 140. A low pass filter 160 may also be provided in the coaxial waveguide structure 112. The dual-hand coaxial hat feed assembly 100 may extend through a bore of a parabolic reflector antenna such as the bore 22 of the parabolic reflector antenna 20 of FIG. 1. Any suitable hub and/or hub or hub adapter may be used to mount the feed assembly 100 in the bore 22 of the parabolic dish antenna 20. One or more transition elements such as, for example, rectangular-to-circular waveguide transitions may be attached to the feed assembly 100 or may be integrated into the feed assembly 100. Additional transition elements according to embodiments of the present invention in the form of feed assembly interfaces may also be used with or integrated into the feed assembly 100, as will be discussed in further detail below.

The coaxial waveguide structure 112 may comprise, for example, an extruded coaxial aluminum waveguide that includes the central waveguide 120 and the outer waveguide 130. Other metal or conductive materials may be used. The outer waveguide 130 may circumferentially surround the central waveguide 120. The central waveguide 120 may have a generally circular transverse cross-section of constant diameter. The outer wall of the central waveguide 120 may be very thin. The central waveguide 120 may have smooth inner walls and may be designed to conduct microwave signals in the basic TE11 mode. The inner diameter of the central waveguide 120 may be, for example, between $0.6\lambda_1$ and $1.2\lambda_1$ in some embodiments, where $\lambda_1$ is the wavelength corresponding to the center frequency of the high-band. It will be appreciated that the high-band will typically have a transmit sub-band and a receive sub-band. The center frequency of the high-band is typically defined as the halfway point between the lowest frequency of the receive sub-band and the highest frequency of the transmit sub-band (assuming that the receive sub-band is at lower frequencies than the transmit sub-band, which typically is the case).

The outer waveguide 130 may have an annular transverse cross-section. The distance between the outer wall of the central waveguide 120 and the inner wail of the outer waveguide 130 may be, for example, a fraction of $\lambda_2$ in some embodiments, where $\lambda_2$ is the wavelength corresponding to the center frequency of the low-band. The central waveguide 120 may be sized so that it will not support propagation of the low-band signals (i.e., the central waveguide 120 rejects any signals in the low-band incident thereon). In one example embodiment, the central waveguide 120 may have an internal diameter of 2.65 mm and outer waveguide 130 may have an internal diameter of 7.4 mm.

The feed section 110 further includes a dielectric support 140. The dielectric support 140 may be formed of a low-loss dielectric material. A base 142 of the dielectric support 140 may be inserted into a distal end of the central waveguide 120. The dielectric support 140 may be impedance matched with the central waveguide 120 so that it efficiently transfers the high-band microwave signals between the central waveguide 120 and the sub-reflector 150. The dielectric support 140 may provide a mechanical support for mounting the sub-reflector 150 at an appropriate distance from the ends of the central and outer waveguides 120, 130. The base 142 of the dielectric support 140 may have a stepped or tapered profile for purposes of impedance matching the dielectric support 140 to the central waveguide 120 to reduce or minimize reflections.

The sub-reflector 150 is mounted on the distal end 144 of the dielectric support 140. The sub-reflector 150 may be mounted at. the focal point of the parabolic reflector antenna 20 (see FIG. 1). The sub-reflector 150 may comprise, for example, a machined metal sub-reflector or a molded sub-reflector. In some embodiments, the sub-reflector 150 may be formed entirely of metal, while in other embodiments the sub-reflector 150 may comprise metal that is sprayed, brushed, plated or otherwise deposited or formed on a dielectric substrate. In some embodiments, this dielectric substrate may be the low-loss dielectric support 140. The sub-reflector 150 may have a circular cross-section (when the cross-section is taken in a direction transverse to the longitudinal dimension of the central waveguide 120). The diameter of the circular cross-section of the sub-reflector 150 may be greater than the diameter of the circular cross-section of the coaxial waveguide structure 112.

The sub-reflector 150 may have a plurality of concentric grooves or rings 152 that are formed in a rear surface thereof that faces the coaxial waveguide structure 112. The concentric grooves 152 include inner grooves 154 and outer grooves 156. The inner grooves 154 will primarily be illuminated by high frequency signals that are passed through the central waveguide 120. The inner grooves 154 may focus the high frequency signals. The inner grooves 154 are smaller than the outer grooves 156 in diameter, and also are typically smaller than the outer grooves 156 in both depth and width. The concentric outer grooves 156 may circumferentially surround the inner grooves 154, both in depth and width. The outer grooves 156 may be larger than the inner grooves 154. The outer grooves 156 may control and/or focus radiation emitted from the outer waveguide 130.

In transmit mode, some portion of the high frequency radiation may illuminate the outer grooves 156 and some portion of the low frequency radiation may illuminate the inner grooves 154. The high frequency energy that illuminates the outer grooves 156 will have a minimal impact on the overall antenna performance. Likewise, the low frequency energy that illuminates the inner grooves 154 will have a minimal impact on the overall antenna performance.

As noted above, the central waveguide 120 may be sized so that it supports propagation of the high frequency signals while rejecting propagation of the low frequency signals. Thus, any received low frequency energy that is reflected by the sub-reflector 150 toward the central waveguide 120 will generally not propagate through the central waveguide 120 to the high-band radio(s). The high frequency signals, however, may generally propagate through both the central waveguide 120 and the outer waveguide 130. Accordingly, the outer waveguide 130 may include a series of annular ridges that project from the outer surface of the central waveguide 120. These ridges form a low pass filter 160 that may reduce or prevent high frequency energy that is incident on the outer waveguide 130 from propagating through the outer waveguide 130 to the low-band radios. Other low-band filter structures or pass-band filters may be used in other embodiments.

Single-band hat feed assemblies are known in the art. For, example, U.S. Pat. No. 4,963,878 to Kildal discloses a hat feed assembly design for a parabolic reflector antenna. However, conventional hat feed assemblies include a single waveguide and only support a single microwave frequency band. The coaxial dual-band hat feed assemblies according to embodiments of the present invention may allow a single parabolic reflector antenna to support two different microwave frequency bands. This may allow more radios to be attached to a microwave antenna system in order to increase system capacity.

As discussed above, the microwave frequency bands that are in commercial use are widely separated in frequency. In some embodiments, dual-band microwave feed assemblies may support two microwave frequency bands where the center frequency of the high-band is at least 1.25 times greater than the center frequency of the low-band. In other embodiments, the dual-band microwave feed assemblies may support two microwave frequency bands where the center frequency of the high-band is at least 1.4 times greater than the center frequency of the low-band. In still other embodiments, the dual-band microwave ed assemblies may support two microwave frequency bands where the center frequency of the high-band is at least twice the center frequency of the low-band. In yet other embodiments, the dual-band microwave feed assemblies may support two microwave frequency bands where the center frequency of the high-band is at least three times the center frequency of the low-band.

Figure 3A:
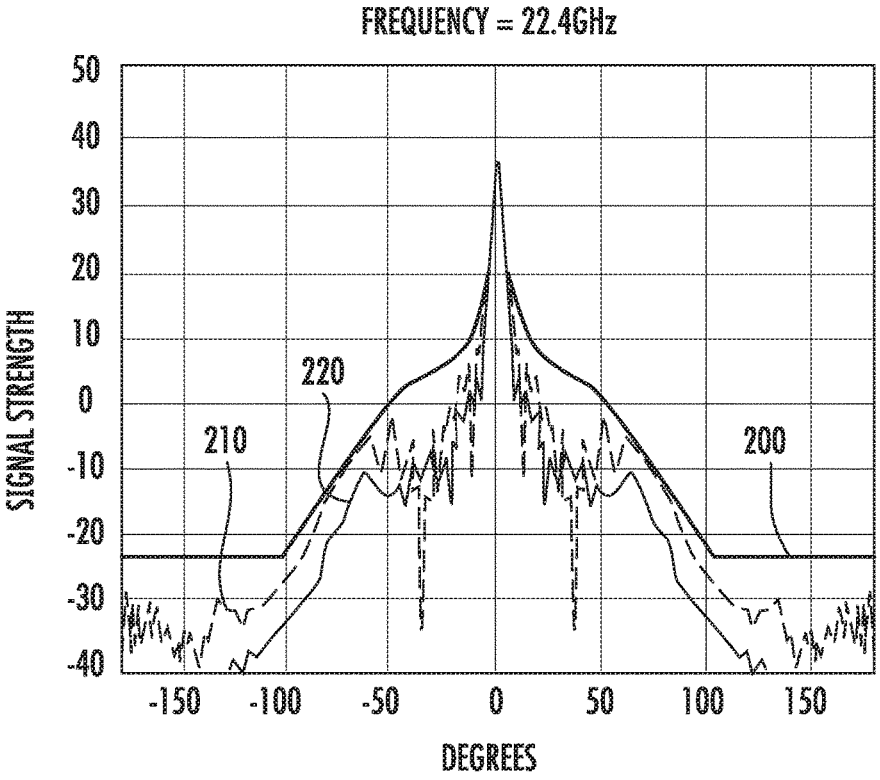
FIG. 3A is a graph of the simulated antenna pattern for the low-hand of a dual-band microwave antenna system that includes the coaxial hat feed assembly of FIG. 2.

Simulation results suggest that microwave antenna systems that use the dual-band coaxial hat feed assembly 100 of FIG. 2 may readily meet the Class 3 performance levels specified by the European Telecommunications Standards Institute ("ETSI") and perhaps Class 4 performance with appropriate antenna/shield optics. For example, FIG. 3A is a graph of the simulated antenna pattern for the low-band of a microwave antenna system that includes the coaxial hat feed assembly of FIG. 2. The graph of FIG. 2 reflects both the azimuth and elevation patterns as the radiation pattern is symmetrical. The graph of FIG. 3A was generated assuming that the feed assembly 100 was used in a 1-foot Valueline® shallow dish parabolic reflector antenna that is sold by CommScope, Inc, of Hickory, N.C. In FIG. 3A, the bold curve 200 represents the envelope for ETSI Class 3 performance. The curves 210, 220 represent the radiated energy levels as a function of pointing direction for a 22.4 GHz signal for two different polarizations. As can be seen, the antenna system meets or exceeds ETSI Class 3 performance.

Figure 3B:
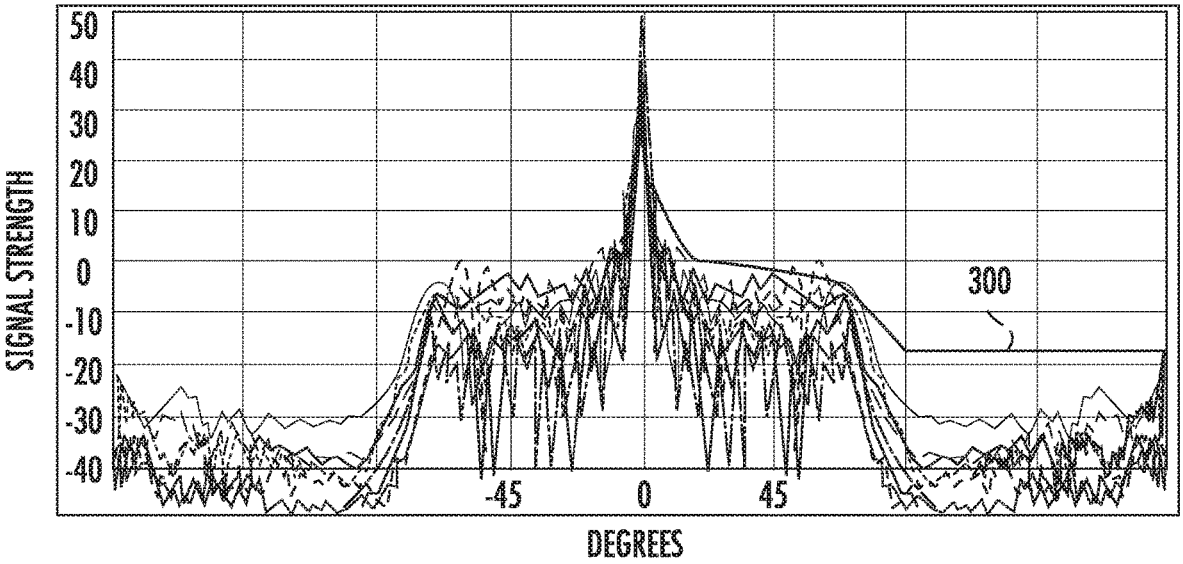
FIG. 3B is a graph of the simulated antenna pattern for the high-band of a dual-band microwave antenna system that includes the coaxial hat feed assembly of FIG. 2.

FIG. 3B is a graph of the simulated antenna pattern for the high-band of a microwave antenna system that includes the coaxial hat feed assembly of FIG. 2. The graph of FIG. 3B was again generated assuming that the feed assembly 100 was used in the above-discussed 1-foot Valueline® shallow dish parabolic reflector antenna. In FIG. 3B, the curve 300 represents the envelope for ETSI Class 3 performance. The remaining curves represent the radiated energy levels as a function of pointing direction for an 80 GHz signal for various different frequencies and polarizations. As can be seen, the antenna system meets or exceeds ETSI Class 3 performance at almost all points along the curve 300. The simulations of FIGS. 3A and 3B are based on an early-stage design and it is anticipated that the small regions of non-compliance may readily be eliminated as the feed assembly design is optimized.

Numerous modifications may be made to the dual-band coaxial hat feed assembly 100 without departing from the scope of the present invention. For example, in further embodiments, other low pass filter structures could be used in place of the series of annular ridges that project from the outer surface of the central waveguide that act as the low pass filter in the above-described embodiment. As another example, in further embodiments, another coaxial waveguide could be added that surrounds the outer waveguide to provide a tri-band feed structure. Other shaped central and outer waveguides may be used in some embodiments such as, for example, waveguides with square as opposed to circular cross-sections. As yet another example, the dielectric support and sub-reflector may be combined as a dielectric with some metalized surfaces.

Figure 4:
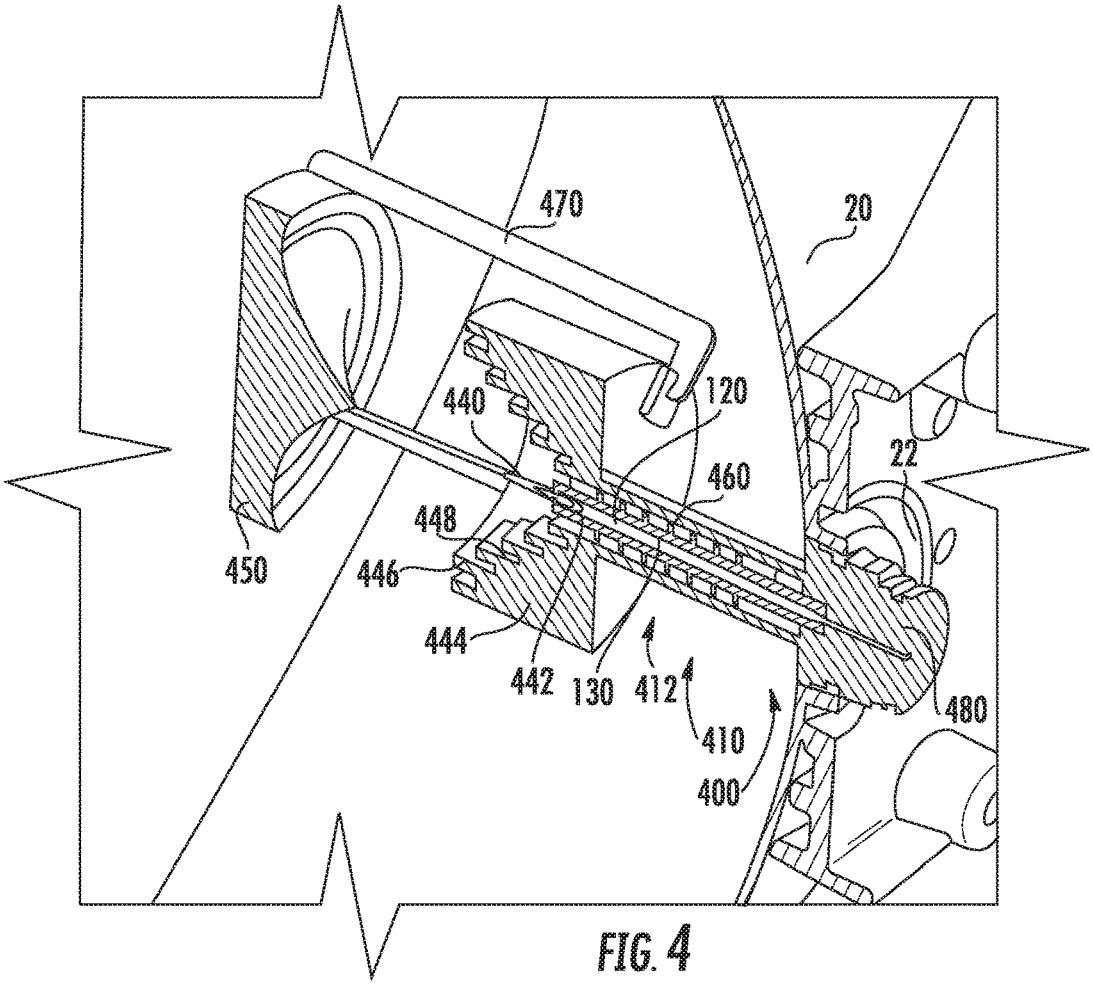
FIG. 4 is a sectional perspective view of a microwave antenna system according to certain embodiments of the present invention that includes a dual-band feed assembly that has a low-band corrugated feed and a high-band dielectric rod feed.

While dual-band coaxial hat feed assemblies are one potential dual-band feed assembly implementation, the present invention is not limited thereto. For example, FIG. 4 is a sectional perspective view of a dual-band coaxial feed assembly 400 according to further embodiments of the present invention. The dual-band coaxial feed assembly 400 includes a feed section 410 that has a coaxial waveguide structure 412 a high-band dielectric feed 440, and a low band corrugated feed 444. The coaxial waveguide structure 412 includes a central waveguide 120 and an outer waveguide 130. The dual-band coaxial feed assembly 400 further includes a broadband sub-reflector 450.

As shown in FIG. 4, the dual-band coaxial feed assembly 400 may be mounted in and/or extend through a bore 22 of a parabolic reflector antenna 20. Any suitable hub and/or hub or hub adapter may be used to mount the feed assembly 400 in the bore 22 of the parabolic reflector antenna 20. A rectangular-to-circular waveguide transition 480 is attached to the feed assembly 400 (or formed as part of the feed assembly 400 or the hub or hub adapter).

The coaxial waveguide structure 412 of the feed section 410 may, for example, be identical to the corresponding coaxial waveguide structure 112 of the feed section 110 of feed assembly 100. In particular, the coaxial waveguide structure 412 of the feed section 410 may include the central waveguide 120 and the outer waveguide 130, where the outer waveguide 130 circumferentially surrounds the central waveguide 120. Further description of the coaxial waveguide structure 412 of the feed section 410 will be omitted since it may be identical to the coaxial waveguide structure 112 feed section 110 described above.

The feed section 410 further includes a high-band dielectric feed 440 and a low-band corrugated feed 444. The high-band dielectric feed 440 may be formed of a low-loss dielectric material. A base 442 of the high-band dielectric feed 440 may be inserted into a distal end of the central waveguide 120 so that signals transmitted through the central waveguide 120 excite the high-band dielectric feed 440. The high-band dielectric feed 440 may be impedance matched with the central waveguide 120 via a series of stepped cylinders or a tapered section so that microwave signals in the high-band are efficiently coupled between the central waveguide 120 and the high-band dielectric feed 440. The portion of the high-hand dielectric feed 440 that extends from the central waveguide 120 may comprise a tapered dielectric rod. This may help to efficiently transition the high-band microwave energy from the high-band dielectric feed 440 to free space.

The low-band corrugated feed 444 may control the radiation characteristics of the low-band signals that arc carried by the outer waveguide 130. For example, the corrugations may shape the radiation patterns so that the low-band microwave energy emitted through the outer waveguide 130 illuminates the sub-reflector 450 without significant loss. The corrugations may also help provide a good impedance match with the outer waveguide 130 to reduce or minimize reflections of the low-band microwave signals. The low-band corrugated feed 444 may be mounted on and/or proximate the distal end of the outer waveguide 130. As shown in FIG. 4, the low-band corrugated feed 444 includes a plurality of radially outwardly protruding annular ridges 446 that are separated by annular valleys 448 that together form the corrugations. The ridges 446 and valleys 448 may have a stepped profile as shown so that the ridges 446 and valleys 448 that are at larger distances from the central waveguide 120 are spaced farther outwardly away from the central waveguide 120. The low-band corrugated feed section 444 may pass microwave energy between the outer waveguide 130 and the sub-reflector 450. It will be appreciated that the corrugations on the low-band corrugated feed 444 may perform many of the same functions as the concentric grooves 152 provided on the sub-reflector 150 of feed assembly 100. The location of the corrugations have simply been moved to the other side of the air interface in the feed assembly 400 of FIG. 4.

The sub-reflector 450 may comprise a broad-band sub-reflector and may have, for example, an axially displaced ellipse shape or a Cassegrain hyperboloid shape. These sub-reflector shapes may be generic shapes that are not optimized for performance over a single frequency band, and hence may be used for multiple frequency bands. In the depicted embodiment, the sub-reflector 450 is separate from both the high-band dielectric feed 440 and the low-band corrugated feed 444. The sub-reflector 450 may have two focal points. One of the focal points may be at the phase center of the feed where energy from the feed radiates in a spherical wave. The other focal point may be at the focal point of the main reflector 20.

A mechanical support 470 such as a bracket is provided for mounting the sub-reflector 450 in front of the central and outer waveguides 120, 130. The outer waveguide 130 may include a low pass filter 460 which may be identical to the low pass filter 160 described above.

The sub-reflector 450 may be mounted at the focal point of the parabolic reflector antenna 20. The high-band microwave signals emitted by both the central waveguide 120 and the low-band microwave signals emitted by the outer waveguide 130 may each illuminate substantially the entirety of the sub-reflector 450 in some embodiments. The sub-reflector 450 may comprise, for example, a machined metal sub-reflector or a molded sub-reflector. In some embodiments, the sub-reflector 450 may be formed entirely of metal, while in other embodiments the sub-reflector 450 may comprise metal that is sprayed, brushed, plated or otherwise deposited or formed on a dielectric substrate. The sub-reflector 450 may have a circular cross-section (when the cross-section is taken in a direction transverse to the, longitudinal dimension of the central waveguide 120). The diameter of the circular cross-section of the sub-reflector 450 may be greater than the diameter of the circular cross-section of the coaxial waveguide structure 412.

As noted above, the central waveguide 120 may be sized so that it supports propagation of the high frequency signals while rejecting propagation of the low frequency signals. Thus, any low frequency energy that is reflected by the sub-reflector 450 toward the central waveguide 120 will generally not propagate through the central waveguide 120 to the high-band radio(s). The outer waveguide 130 includes the low pass filter 460 that may reduce or prevent high frequency energy that is incident on the outer waveguide 130 from propagating through the outer waveguide 130 to the low-band radios.

It will be appreciated that the outer waveguide 130 may be configured as the high-band waveguide and the central waveguide 120 may be configured as the low-band waveguide in other embodiments. In such embodiments, other elements would be rearranged accordingly (e.g., the low pass filter would be within the central waveguide 120, etc.). The same is true with respect to the feed assembly 100 of FIG. 2.

While not shown in the figures, it will be appreciated that each of the microwave antenna systems disclosed herein may include other conventional components such as radomes, RF shields, antenna mounts and the like. If RF shields and/or radomes are provided, the shields and radomes may be broadband RF shields and radomes. In particular, the radomes may be designed to efficiently pass microwave energy in both the low-band and high-band microwave frequency bands, and the RF shields may be designed to reflect/block/absorb microwave signals in both microwave frequency bands. It will also be appreciated that while the feed assemblies have been primarily described above with respect to signals that are transmitted therethrough, the feed assemblies are bi-directional and are likewise used to received low-band and high-band microwave signals that are incident on parabolic reflector antennas that include the feed assemblies and to pass those signals to respective low-hand and high-band radios.

Embodiments of the present invention also encompass feed assembly interfaces that may be used to pass microwave signals between a conventional rectangular waveguide and the outer waveguides 130 of the coaxial feed assemblies according to embodiments of the present invention. These feed assembly interfaces may be used, for example, to pass microwave signals in the lower frequency band between a coaxial feed assembly and a feeder waveguide that connects to, for example, a radio.

Figure 5A:
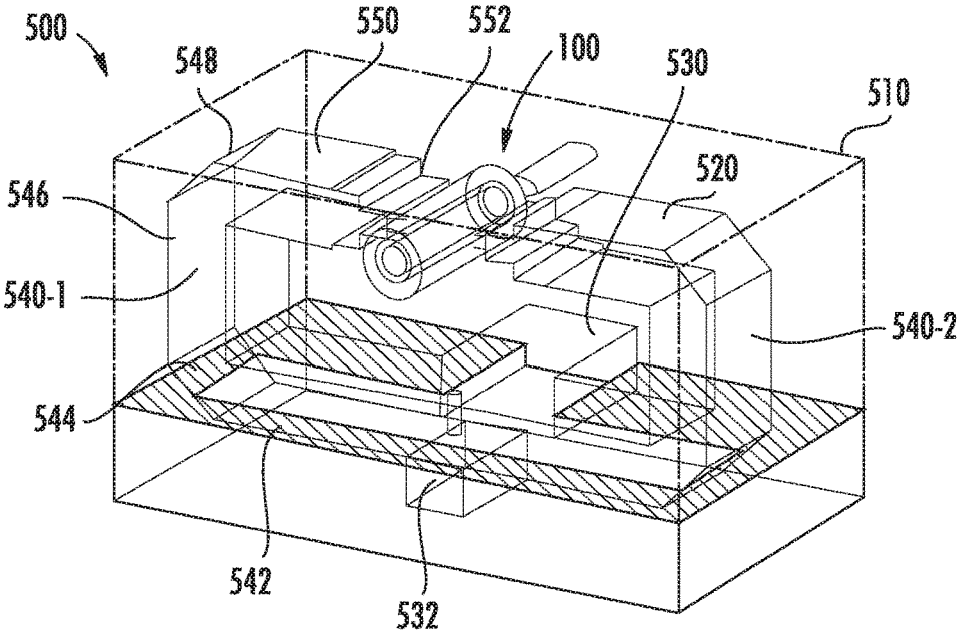
FIG. 5A is a perspective sectional view of a feed assembly interface according to certain embodiments of the present invention that is taken along a horizontal cross-section of the feed assembly interface and that illustrates a portion of the feed assembly interface in phantom view.
Figure 5B:
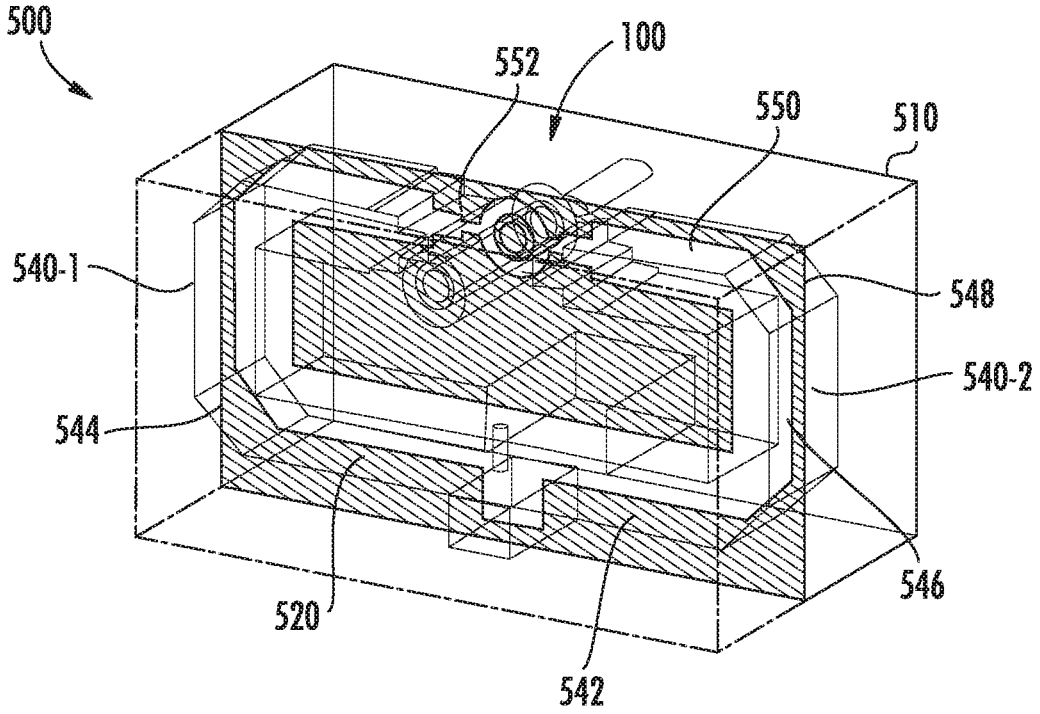
FIG. 5B is a perspective sectional view of the feed assembly interface of FIG. 5A that is taken along a vertical cross-section of the feed assembly interface and that illustrates a portion of the feed assembly interface in phantom view.
Figure 5C:
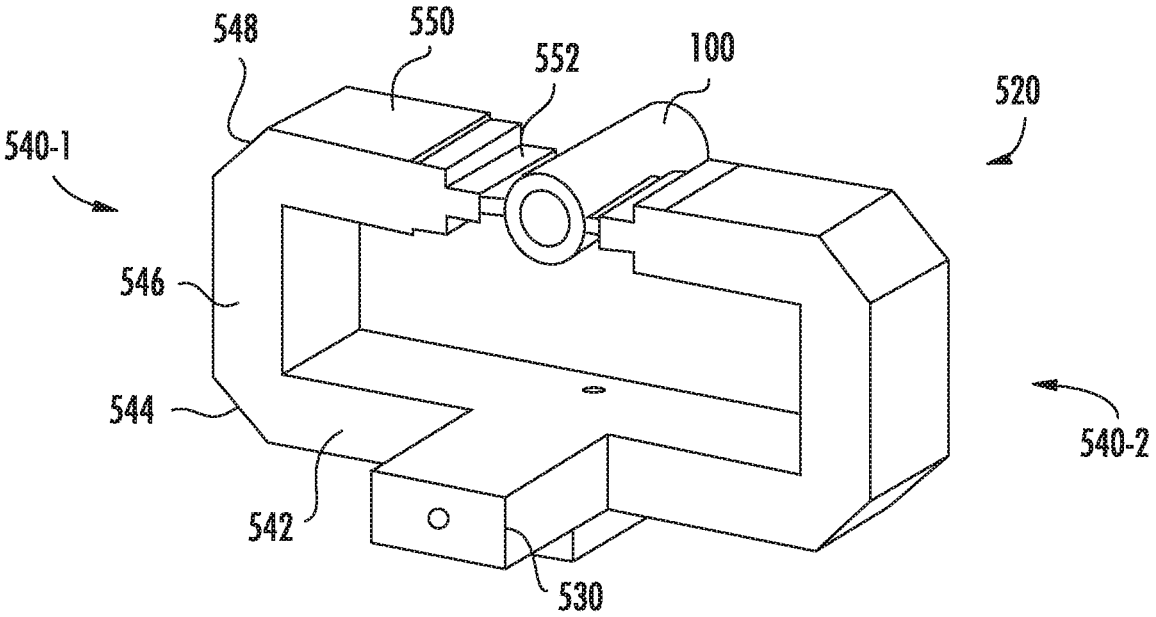
FIG. 5C is a perspective view that illustrates the internal pathways in the feed assembly interface of FIGS. 5A-5B.
Figure 5D:
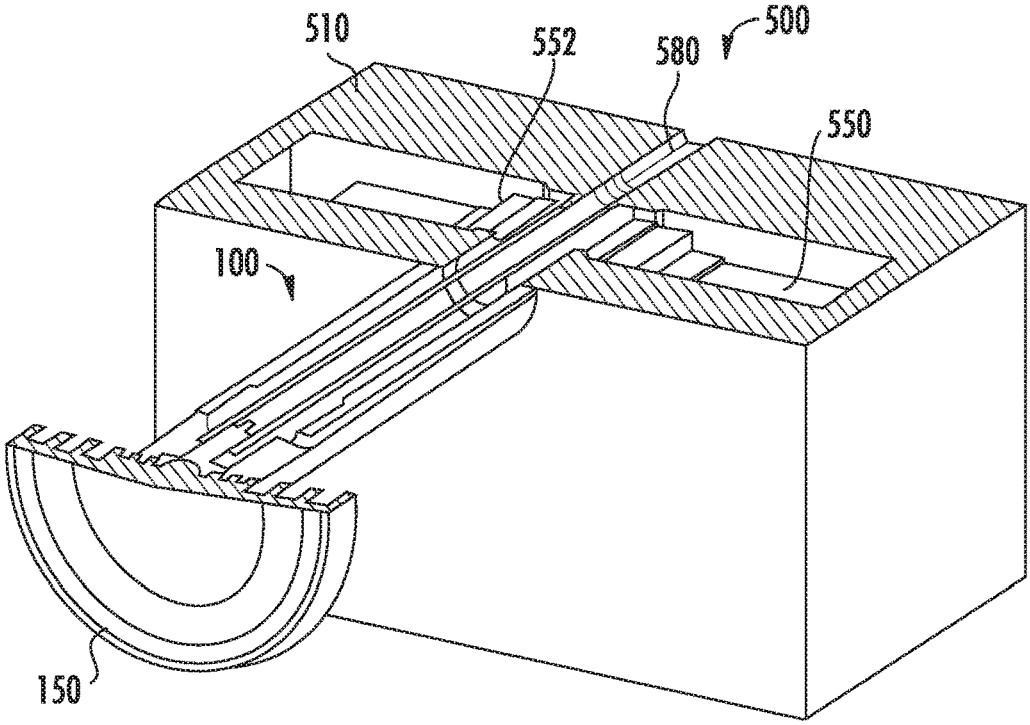
FIG. 5D is a perspective cross-sectional view of the feed assembly interface of FIGS. 5A-5C connected to a coaxial hat feed assembly.
Figure 5E:
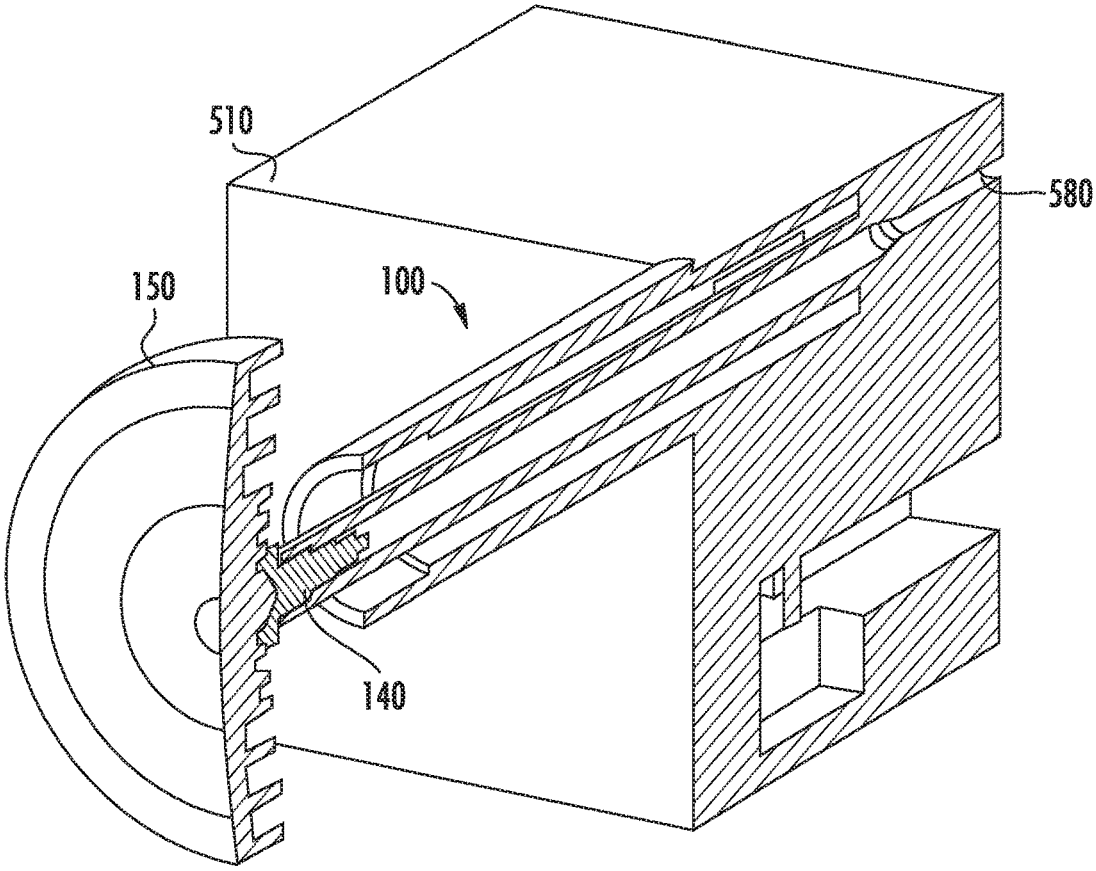
FIG. 5F is another perspective cross-sectional view of the feed assembly interface of FIGS. 5A-5C connected to the coaxial hat feed assembly.
Figure 5F:
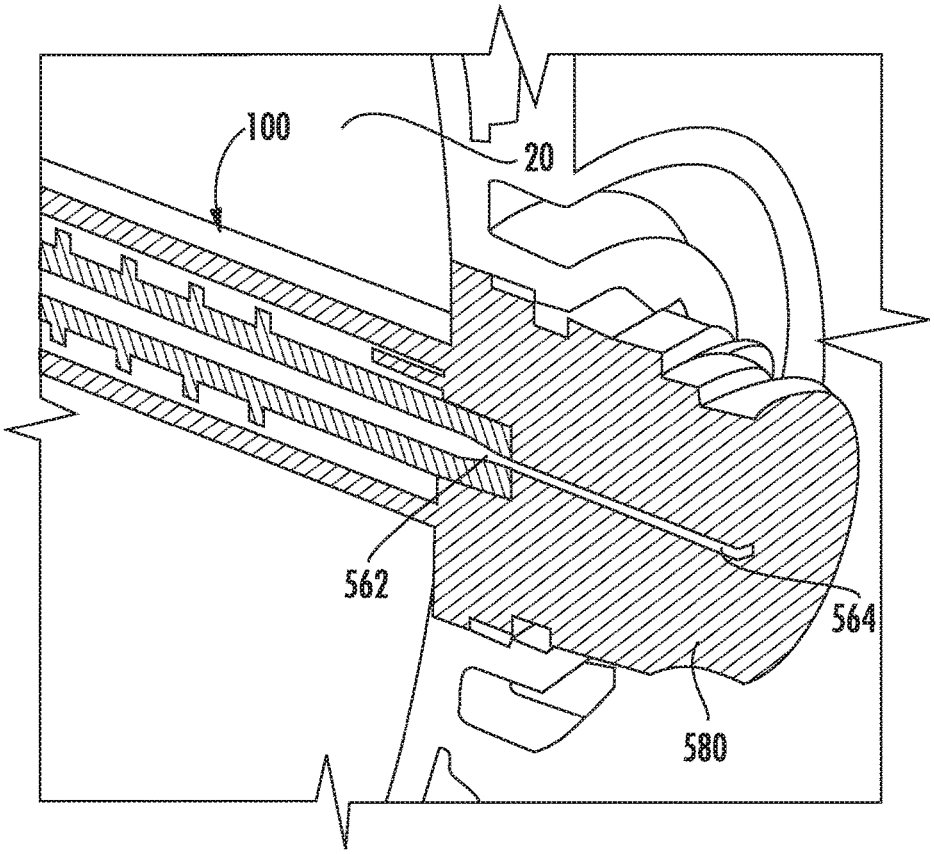

FIGS. 5A-5F illustrate a feed assembly interface 500 according to embodiments of the present invention. In particular, FIG. 5A is a perspective sectional view of the feed assembly interface 500 that is taken along a horizontal cross-section and that illustrates a portion of the feed assembly interface 500 in phantom view. FIG. 5B is a perspective sectional view of the feed assembly interface 500 that is taken along a vertical cross-section and that illustrates another portion of the feed assembly interface 500 in phantom view. FIG. 5C is a perspective view that illustrates the internal pathways in the feed assembly interface 500. In other words, the structural components shown in FIG. 5C represent the open areas in the body 510 of the feed assembly shown in FIGS. 5A-5B. FIG. 5D is a perspective cross-sectional view of the feed assembly interface 500 connected to a coaxial hat feed assembly. FIG. 5E is another perspective cross-sectional view of the feed assembly interface 500 connected to the coaxial hat feed assembly. Finally, FIG. 5F is a cross-sectional perspective view of a portion of a microwave antenna system that may use the feed assembly interface of FIGS. 5A-5E.

The feed assembly interface 500 may be implemented using a rectangular waveguide power splitter such as a Magic T structure, as will be discussed in further detail below. The feed assembly interface 500 may be used to pass signals between a conventional rectangular waveguide and the outer waveguide of a feed assembly according to embodiments of the present invention.

Referring first to FIGS. 5A and 5B, the feed assembly interface 500 includes a body 510 that has pathways 520 (i.e., open areas) formed therein. FIG. 5C illustrates the pathways 520 that are formed in the body 510. As shown in FIG. 5C, the pathways 520 include a rectangular waveguide interface 530 and first and second symmetrical waveguide arms 540-1, 540-2 which extend at right angles from either side of the rectangular waveguide interface 530. The arms 540 may equally split the microwave energy fed into the feed assembly interface 500 through the rectangular waveguide interface 530. The microwave energy passed along the respective arms 540-1, 540-2 is maintained in phase. Each arm 540 includes a first segment 542, a first ninety degree transition 544, a second segment 546, a second ninety degree transition 548 and a third segment 550. Thus, each arm 540 may wrap around 180 degrees to excite respective opposite sides of the outer waveguide 130 of the feed assembly 100 (note that the central waveguide 120 is not shown in FIG. 5C). The distal end of each third segment 550 narrows in cross-sectional height and/or width through a series of matched resonant slots 552. These slots 552 may be designed to excite the coaxial TE11 mode in the outer waveguide 130 that can be radiated in a linear polarization in the outer waveguide 130 where the linear polarization is in the same direction as the width dimension of the rectangular waveguide interface 530 (which would be a horizontal polarization in the embodiment of FIGS. 5A-5C). The feed assembly interface 500 may readily be used to feed a vertically polarized signal into the outer waveguide 130 by merely rotating the feed assembly interface 500 by 90 degrees with respect to the coaxial feed assembly 100. The feed assembly interface 500 is reciprocal so that it can operate in both transmit and receive mode (i.e., it can pass the microwave signals therethrough in either direction).

As shown in FIG. 5D, the third section 550 of each arm 540 ends at the base of a feed assembly of the microwave antenna system. The feed assembly may comprise, for example, the feed assembly 100 of FIG. 2 above or the feed assembly 400 of FIG. 4 above. In the depicted embodiment, the feed assembly shown is the coaxial hat feed assembly 100 of FIG. 2. It will be appreciated, however, that the feed assembly shown in FIG. 5D could he any of the feed assemblies according to embodiments of the present invention or modifications thereof.

Still referring to FIG. 5D, it can be seen that the matched resonant slots 552 are used to feed the low-band microwave signals into the outer waveguide 130 of feed assembly 100. The feed assembly interface 500 may also include a conventional rectangular-to-circular waveguide transition 580 (see FIG. 5F) which connects to the end of the central waveguide 120 of feed assembly 100. The rectangular-to-circular waveguide transition 580 provides a low-loss conversion from the standard rectangular waveguide format used for connecting to a radio to the circular waveguide format of the central waveguide 120 of feed assembly 100.

FIG. 5F is a cross-sectional view of a feed assembly according to embodiments of the present invention mounted in a parabolic reflector antenna, when the feed assembly interface includes a standard circular-to-rectangular waveguide transition 580. In FIG. 5F, the feed assembly interface 500 that feeds the low band signals to the outer waveguide 130 of feed assembly 100 is omitted to simplify the drawing. As can be seen in FIG. 5F, the circular-to-rectangular waveguide transition 580 includes a stepped transition 562 that provides a good impedance match between the circular central waveguide 120 and a rectangular waveguide 564 that may be connected to a high-band radio via, for example, another rectangular waveguide (not shown).

Referring now to FIGS. 5D and 5E, it can be seen that the dielectric support 140 is mounted'in the central waveguide 120 of feed assembly 100. The dielectric support 140 matches the RF energy from the central waveguide 120 that is incident on the sub-reflector 150. The dielectric support 140 is used to mount the sub-reflector 150 at the focal point for the parabolic reflector antenna. High-band microwave signals pass through the dielectric support 140 to the center portion of the sub reflector 150. Low-band microwave signals pass from the outer waveguide 130 to the outer portion of the sub-reflector 150 via an air (free space) interface.

The feed assembly interface 500 may operate as follows. First, referring to FIG. 5A, the section view illustrates the "T-junction" 532 of the Magic T power splitter. The low-band microwave energy is received from the radio (not shown) through a rectangular waveguide (not shown) at the rectangular waveguide interface 530. The low-band energy travels to the T-junction 532 where it is equally split to flow into the respective first and second waveguide arms 540-1, 540-2. As noted above, the microwave signals traveling through the respective arms 540 are in-phase with each other. Referring now to FIGS. 5B and 5C, the microwave energy travels through the respective sections 542, 544, 546, 548, 550 of each arm 540. At the end of section 550 of each arm 540, the height of the rectangular waveguide may be gradually decreased in a stepped fashion to form the slots 552 that may provide an improved impedance match between the rectangular waveguide of each arm 540 and the annular outer waveguide 130 of the feed assembly 100. Referring now to FIGS. 5D and 5E, the above-described matched connection allows the signal energy to pass from the feed assembly interface 500 into the outer waveguide 130 of feed assembly 100 so that the low-band microwave signals may propagate down the outer waveguide 130 to the sub reflector 150. As shown in FIGS. 5D-5F, the high-band microwave signals may be fed to the sub-reflector 150 via the rectangular-to-circular waveguide transition 580, the central waveguide 120 and the dielectric support 140 of feed assembly 100.

In an example embodiment, the low frequency band may be the 23 GHz frequency band (specifically a band from 21.2-23.6 GHz) and the high frequency band may be the 80 GHz frequency band (specifically a first band from 71-76 GHz and a second band from 81-86 GHz).

Figure 8A:
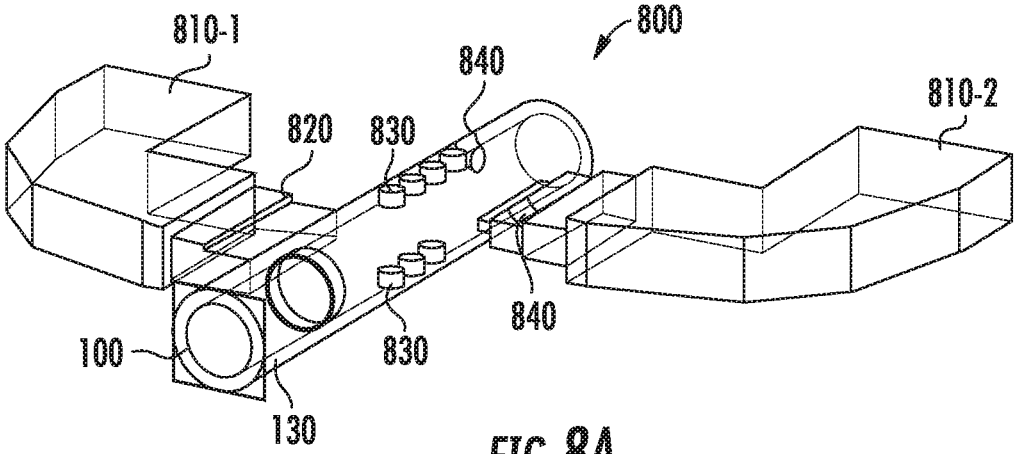
FIG. 8A is a perspective phantom view of a feed assembly interface according to further embodiments of the present invention.
Figure 8B:
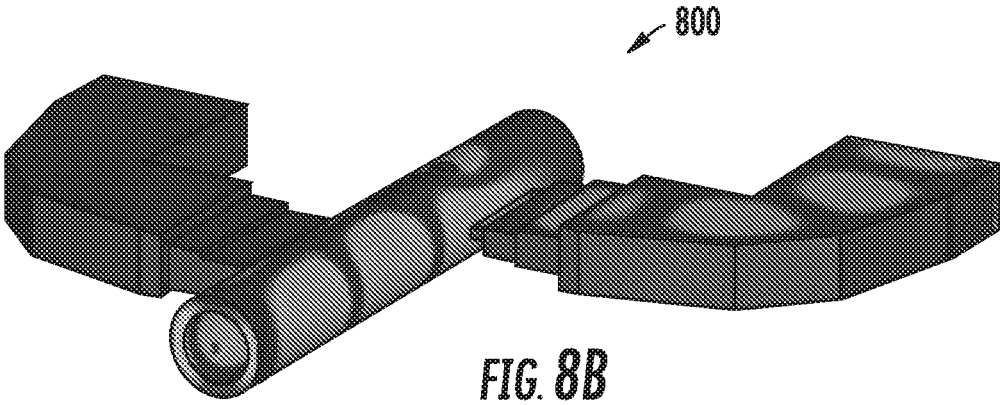
FIGS. 8B and 8C are perspective views of the feed assembly interface of FIG. 8A that illustrate the transmission paths through the feed assembly interface.
Figure 8C:
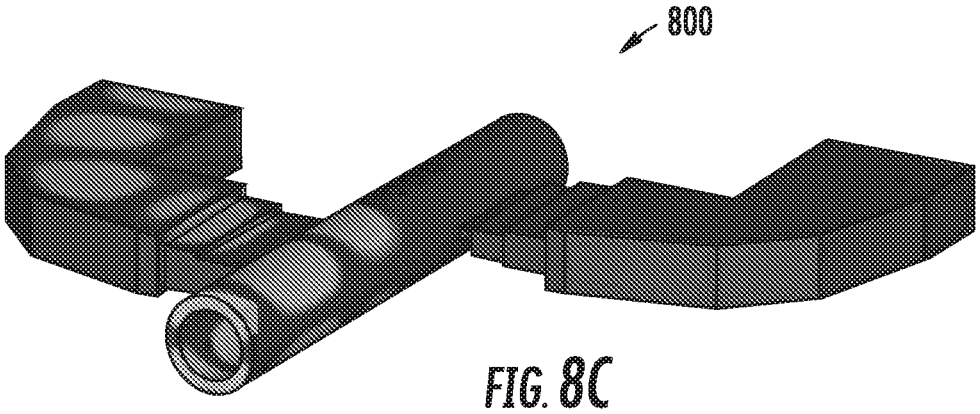

FIGS. 8A-8C illustrate an alternative feed assembly interface 800 according to further embodiments of the present invention. In particular, FIG. 8A is a perspective phantom view of the feed assembly interface 800, and FIGS. 8B and 8C are perspective views of the feed assembly interface 800 that illustrate the transmission paths through the two respective feed paths of the feed assembly interface 800 and through an associated feed assembly. The feed assembly interface 800 may be used in place of the feed assembly interface 500 that is described above, and allows feeding a pair of orthogonally polarized low-band signals into the feed assemblies according to embodiments of the present invention.

The feed assembly interface 800 may be implemented using a pair of J-hook bends 810-1, 810-2 in conjunction with shorting and/or tuning pins 830, 840. The wide end of each J-hook bend 810 may be connected to respective first and second ports of a radio. As shown in FIG. 8A, each J-hook bend 810 comprises a rectangular waveguide that includes a ninety degree bend. The J-hook bends 810 connect to the outer waveguide 130 of feed assembly 100. The J-hook bends 810 connect at different points along the longitudinal length of the outer waveguide 130. The distal portion of each J-hook bend 810 (i.e., the portion that connects to the coaxial feed assembly 100) narrows in cross-sectional height and/or width through a series of matched resonant slots 820. The slots 820 in each J-hook bend 810 may be designed to excite the coaxial TE11 mode in the outer waveguide 130 that can be radiated in a linear (vertical) polarization in the outer waveguide 130.

As is further shown in FIG. 8A, a plurality of shorting pins 830 may be provided within the outer waveguide 130. Additionally, a pin 840 is positioned at a forty-five degree angle through the outer waveguide 130, and placed at or about the point along the coaxial feed assembly 100 where the distal end of the J-hook bend 810-2 feeds energy into the outer waveguide 130.

The feed assembly interface 800 may operate as follows. A first vertically polarized microwave signal is fed to the outer waveguide 130 through J-hook bend 810-1. The matched resonant slots 820 in the distal portion of J-hook bend 810-1 excite the coaxial TE11 mode in the outer waveguide 130 that is radiated in a vertical polarization in the outer waveguide 130. The shorting pins 830 may block microwave energy associated with this first microwave signal from traveling in the rearward direction toward J-hook bend 810-2, and hence the first microwave signal is transmitted forwardly through the outer waveguide 130 toward the waveguide aperture and sub-reflector (not shown). A second vertically polarized microwave signal is fed to the outer waveguide 130 through J-hook bend 810-2. The matched resonant slots 820 in the distal portion of J-hook bend 810-2 excite the coaxial TE11 mode in the outer waveguide 130 that is radiated in a vertical polarization in the outer waveguide 130. As the microwave signal exits J-hook bend 810-2, the vertically disposed shorting pins 830 direct the microwave signal rearwardly. The pin 840 that is positioned at a forty-five degree angle acts to rotate the polarization of the second microwave signal by ninety degrees to a horizontal polarization, and redirects the microwave energy toward the front of the feed assembly 100. The vertically-disposed shorting pins 830 are effectively invisible to the horizontally polarized signal, allowing the horizontally polarized signal to pass in the forward direction. Thus, the feed assembly interface 800 provides a convenient mechanism for feeding two low-band microwave signals into a feed assembly that are transmitted through the feed assembly at orthogonal polarizations.

FIGS. 8B and 8C show the signal paths for the respective horizontally polarized and vertically polarized signals. In these figures, the cross-hatching represents the microwave energy. As shown in FIG. 8C, the first vertically polarized signal is fed into the outer waveguide 130 through J-hook bend 810-1 and travels forwardly through the outer waveguide 130. As shown in FIG. 8B, the second vertically polarized signal is fed into the outer waveguide 130 through J-hook bend 810-2, and is then rotated into a horizontal polarization and then travels forwardly through the outer waveguide 130.

While not shown in FIGS. 8A-8C, other asymmetrical pins and/or small metallic rings can be added to the feed assembly interface 800 to improve the efficiency of the structure. It will also be appreciated that the feed assembly interface 800 is reciprocal so that it can operate in both transmit and receive mode (i.e., it can pass the microwave signals therethrough in either direction).

As described above, the J-hook bends 810 may be used to feed a pair of microwave signals into a feed assembly according to embodiments of the present invention so that the signals travel through the feed assembly at orthogonal polarizations. While not shown in FIGS. 8A-8C, the feed assembly interface 800 may also include a conventional rectangular-to-circular waveguide transition such as the rectangular-to-circular waveguide transition 560 illustrated in FIG. 5F above. This rectangular-to-circular waveguide transition may be used to connect a high-band radio to the end of the central waveguide 120 of feed assembly 100.

While FIGS. 8A-8C illustrate the feed assembly interface 800 connecting to the feed assembly 100, it will be appreciated that the feed assembly interface 800 may be used with any of the feed assemblies according to embodiments of the present invention disclosed herein or modifications thereof.

Figure 6A:
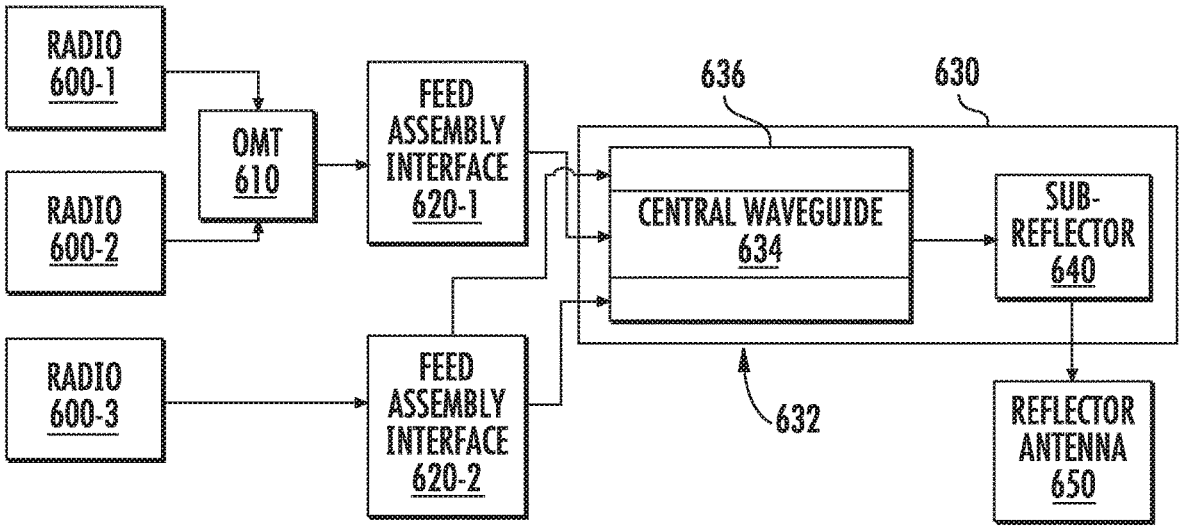
FIG. 6A is a schematic block diagram of a microwave antenna system according, to embodiments of the present invention that includes orthomode transducers that may be used to feed the central and/or outer waveguide of a coaxial feed assembly with a pair of orthogonally polarized signals.

In the embodiments of the present invention described above, the high-band portion of the feed assembly interface 500 is configured to transmit/receive signals of a single polarization. As shown in FIG. 6A, in an alternate embodiment, an orthomode transducer ("OMT") 610 may also be provided that allows a central waveguide 634 of a feed assembly 630 to be fed with a pair of orthogonally polarized signals that are provided by first and second high-band radios 600-1, 600-2 (or by first and second ports of the same high-band radio 600). The OMT 610 combines the orthogonally polarized signals and feeds them to a feed assembly interface 620-1 such as a rectangular-to-circular wave guide transition that is connected, to the central waveguide 634 of the feed assembly 630. The feed assembly 630 includes a coaxial waveguide structure 632 that has the central waveguide 634 and an outer wave aide 636. The feed assembly 630 further includes a sub-reflector 640. The orthogonally polarized high-band microwave signals pass from the central waveguide 634 to the sub-reflector 640, and these signals reflect off the sub-reflector 640 onto a parabolic reflector antenna 650.

Low-band microwave signals are fed to a feed assembly interface 620-2 which may be implemented as, for example, the feed assembly interface 500 that is described above. The feed assembly interface 620-2 passes the low-band microwave signals from a low-band radio 600-3 to the outer waveguide 636. The low-band microwave signals pass from the outer waveguide 636 to the sub-reflector 640 which reflects the low-band microwave signals onto the parabolic reflector antenna 650. Thus, it can be seen that by using an orthomode transducer 610, a microwave antenna system may be provided that supports two, orthogonally polarized high-band signals along with a low-band signal. Feed assembly interface 800, shown in FIG. 8A, is effectively an orthomode transducer for the low band frequency allowing the antenna to be fed with a pair of orthogonally polarized signals. As orthomode transducers are well known in the art, further description thereof will be omitted.

Figure 6B:
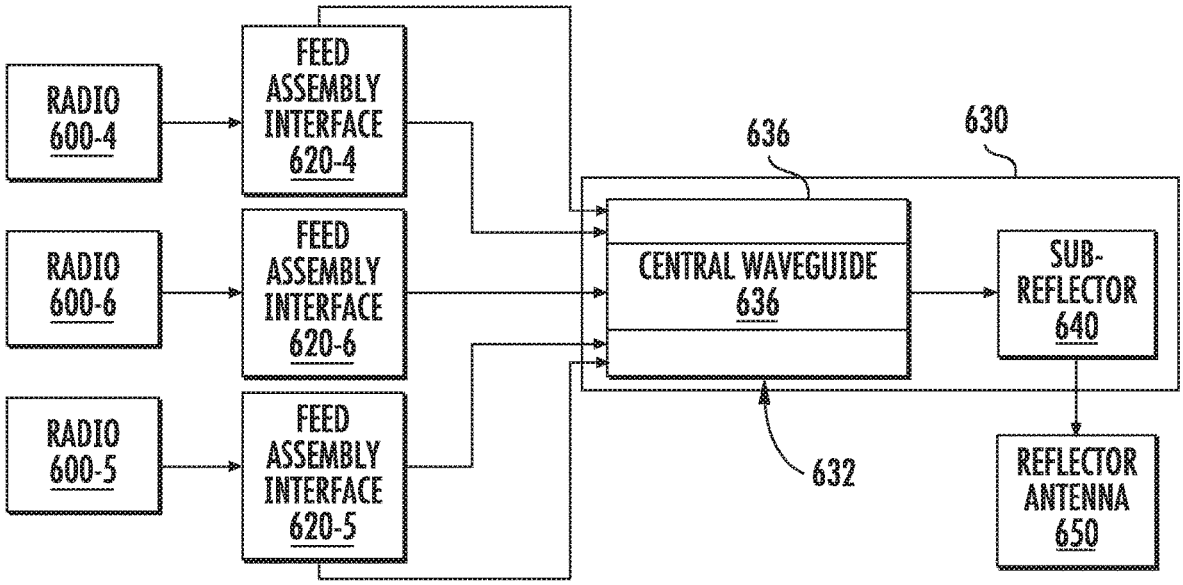
FIG. 6B is a schematic block diagram of a microwave antenna system according to embodiments of the present invention that includes a pair of feed assembly interfaces that may be used to feed an outer waveguide of a coaxial feed assembly with a pair of orthogonally polarized signals.

In the embodiment of the present invention described above, the low-band portion of the feed assembly interface 500 is configured to transmit/receive signals of a single polarization. As shown in FIG. 6B, in an alternative embodiment, a pair of feed assembly interfaces 620-4, 620-5 are provided that may be used to feed, a pair of orthogonally polarized low-band signals from low-band radios 600-4, 600-5 to the outer waveguide 636. In this embodiment, the microwave antenna system includes a feed assembly 630 that has the coaxial waveguide structure 632 that includes the central waveguide 634 and the outer waveguide 636. The feed assembly 630 further includes the sub-reflector 640. The sub-reflector 640 may be used to reflect signals that are output from the feed assembly 630 onto a parabolic reflector antenna 650.

Figure 6C:
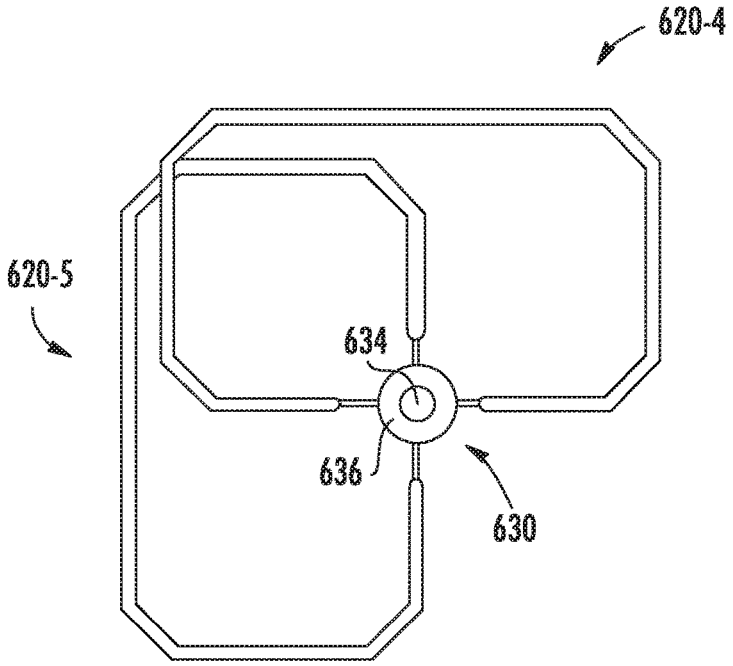
FIG. 6C is a schematic perspective diagram illustrating the internal pathways of a dual polarized feed assembly interface that may be used to feed cross-polarized microwave signals to an outer waveguide of a dual-band coaxial feed assembly.

Each feed assembly interface 620-4, 620-5 may be implemented as the feed assembly interface 500 that is described above. The feed assembly interface 620-4 may be rotated ninety degrees with respect to the feed assembly interface 620-5 and may be offset from the feed assembly interface 620-5 along the longitudinal direction of the central waveguide 634 of feed assembly 630. This arrangement is shown in FIG. 6C schematically. As shown in FIG. 6C, the arms of the feed assembly interface 620-4 may connect to the outer waveguide 636 at two locations that are 180 degrees offset from each other (namely, at the positions of 3:00 and 9:00 if the transverse cross-section of the outer waveguide 636 is viewed as a clock). Likewise, the arms of the feed assembly interface 620-5 may connect to the outer waveguide 636 at two additional locations that are 180 degrees offset from each other (namely, at the positions of 12:00 and 6:00 when the transverse cross-section of the outer waveguide 636 is viewed as a clock). The feed assembly interface 620-4 may be longitudinally offset from the feed assembly interface 620-5 (i.e., further into the page or further out of the page in the view of FIG. 6C) so that the pathways (open areas in the body) of the feed assembly interfaces 620-4, 620-5 do not intersect each other. In this fashion, two orthogonally polarized low-band microwave signals may be fed into the outer waveguide 636.

In the embodiment of FIG. 6B, a single high-band radio 600-6 is provided that feeds high-band microwave signals to the central waveguide 634. It will be appreciated that the high-band radio 600-6 and the feed assembly interface 620-6 of FIG. 6B may be replaced with the two high-band radios 600-1 and 600-2 (or two ports of one high-band radio), the OMT 610 and the feed assembly interface 620-1 of FIG. 6A to provide a microwave antenna system that transmits orthogonally polarized signals in both the low-band and in the high-band.

As should be clear from the above discussion with respect to FIGS. 6A and 6B, the microwave antenna systems according to embodiments of the present invention may support, for example, (1) a single low-band radio and a single high-band radio, (2) a single low-band radio and two orthogonally polarized high-hand radios, (3) a single high-band radio and two orthogonally polarized low-band radios, or (4) two orthogonally polarized low-band radios and two orthogonally polarized high-band radios.

Figure 7:
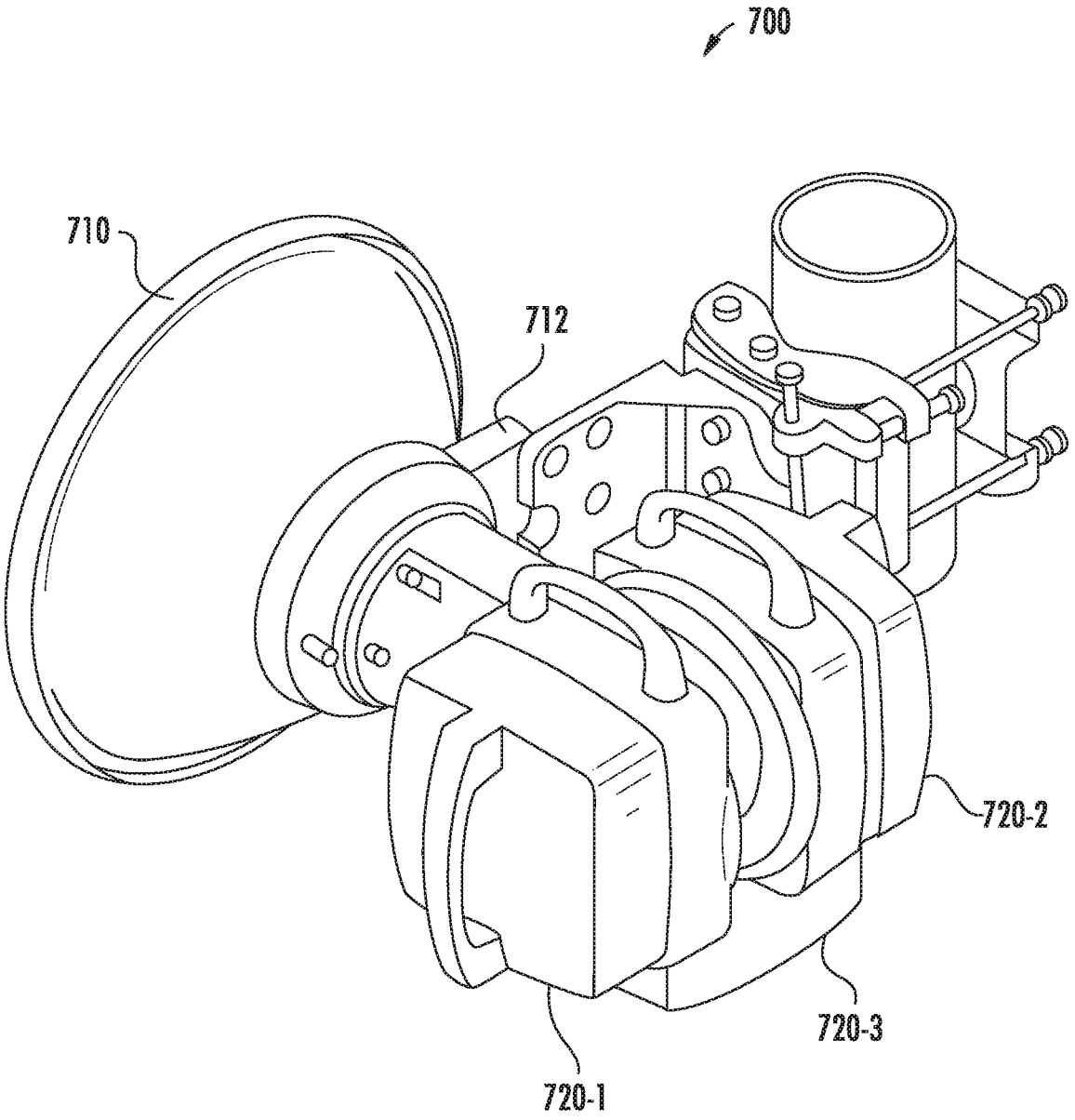
FIG. 7 is a schematic perspective view of a microwave antenna system according to embodiments of the present invention.

FIG. 7 is a schematic perspective view of a microwave antenna system 700 according to embodiments of the present invention that includes a single high-band radio and two orthogonally polarized low-band radios (i.e., microwave antenna system 700 may have the configuration of FIG. 6B). As shown in FIG. 7, the microwave antenna system 700 includes a parabolic reflector antenna 710 that includes a hub 712, and first and second low-band radios 720-1, 720-2, a high-band radio 720-3 (the high-band radio 720-3 is shown schematically in FIG. 7).

While the feed assembly interface 500 of FIGS. 5A-5F uses a Magic T power splitter, it will be appreciated that feed assembly interfaces according to further embodiments of the present invention may use other power splitters. For example, in other embodiments conventional 3 dB power splitters could be used in place of the Magic T power splitter included in feed interface 500. It will also be appreciated that the power splitter may split the power more than two ways. For example, a four-way power splitter may be used to feed microwave signals to four rotationally offset locations on an outer waveguide that are spaced apart from each other at about, for example, ninety degree angular rotations.

Pursuant to further embodiments of the present invention, various modifications may be made to the above example embodiments to, for example, provide improved performance and/or to simplify and/or streamline manufacturing.

For example, as discussed above, the coaxial waveguide structures according to embodiments of the present invention may include a low pass filter (e.g., low pass filter 160) within the outer waveguide (e.g., outer waveguide 130) in order to block high frequency signals from passing through the outer waveguide 130. As discussed above, the low pass filter 160 may be implemented by forming annular ridges on the outer surface of the central waveguide 120 where these annular ridges project into the outer waveguide 130. In practice, however, it may be difficult to control tolerances and/or to control the concentricity of the annular ridges, particularly on relatively long coaxial waveguide structures that may be used in antennas having larger and/or deeper parabolic reflectors. Thus, in some embodiments, one or more changes may be made to the coaxial waveguide structure design to improve performance and/or simplify manufacturing.

Figure 9A:
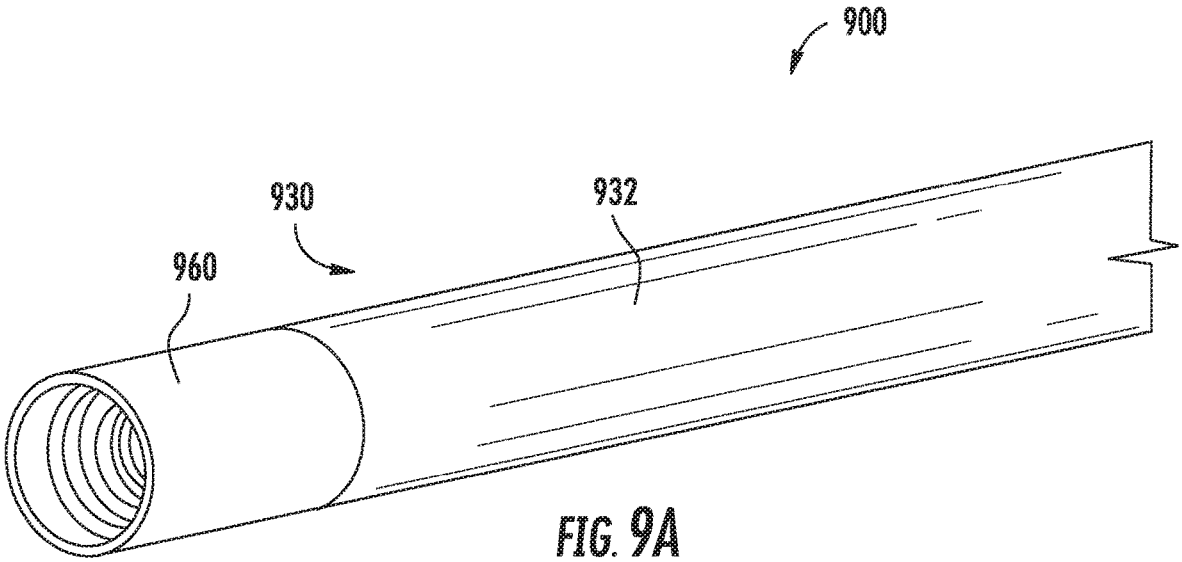
FIG. 9A is a perspective view of a multi-piece coaxial waveguide structure according to embodiments of the present invention.
Figure 9B:
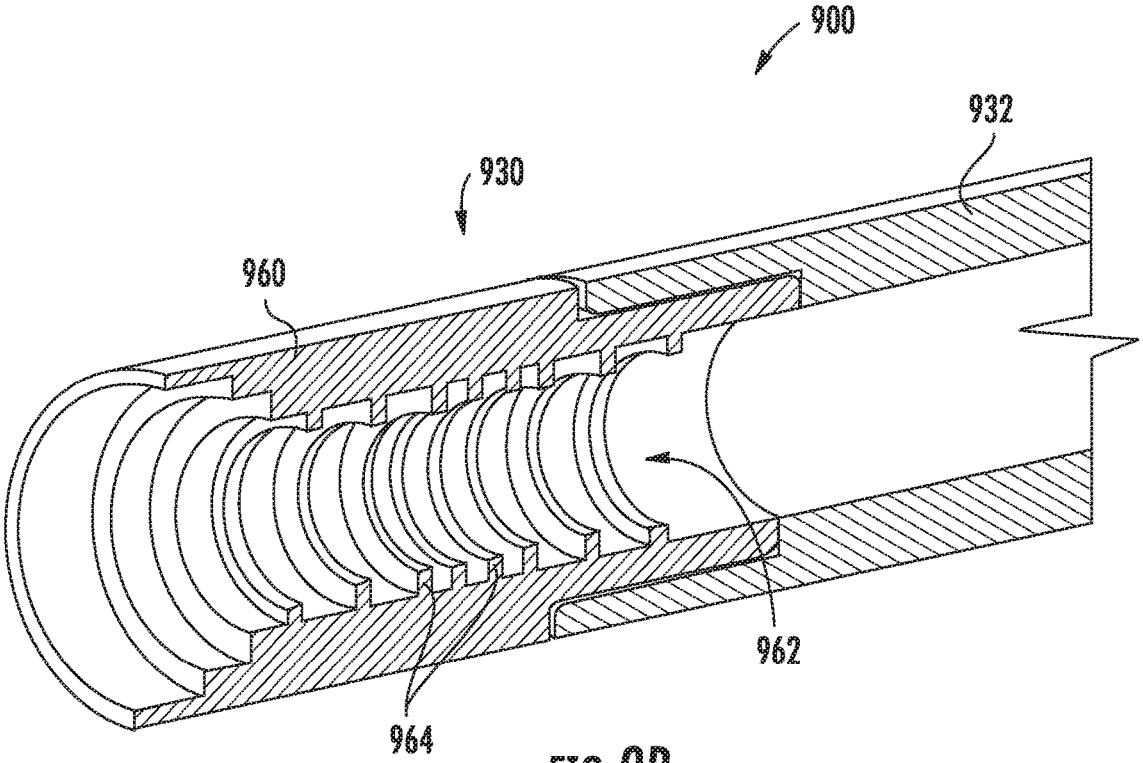
FIG. 9B is a cross-sectional view of an end portion of the multi-piece coaxial waveguide structure of FIG. 9A with the central waveguide omitted.

FIGS. 9A and 9B illustrate a multi-piece coaxial waveguide structure 900 according to embodiments of the present invention that may provide such benefits. FIG. 9A is a perspective view of the multi-piece coaxial waveguide structure 900, while FIG. 9B is a cross-sectional view of an end portion of the multi-piece coaxial waveguide structure 900 with the central waveguide omitted.

As shown in FIGS. 9A-9B, the outer waveguide portion 930 of the coaxial waveguide structure 900 is implemented as a two-piece structure that includes a low pass filter portion 960 and an outer boom portion 932. A central waveguide (not show) may be inserted into the middle of the outer waveguide 930. This central waveguide may be identical to the central waveguide 120 included in the embodiments of FIGS. 2 and 4 that are discussed above, except that the central waveguide included in the coaxial waveguide structure 900 does not have ridges formed in the outer surface thereof to provide a low pass filter 160. Instead, in the coaxial waveguide structure 900 of FIGS. 9A-9B, the low pass filter 962 is implemented as radially-inwardly extending ribs 964 that are formed on the inner surface of the outer waveguide portion 930. Moreover, in the coaxial waveguide structure 900 of FIGS. 9A-9B, the low pass filter 962 is implemented in a separate piece 960 from the outer boom portion 932 that acts as the majority of the outer waveguide 930. The low pass filter portion 960 may be at or near the distal end of the coaxial waveguide structure 900, where the distal end of the coaxial waveguide structure 900 is the end that receives the dielectric support (e.g., dielectric support 140 of FIG. 2) or a high band dielectric feed (e.g., high band dielectric feed 440 of FIG. 4).

The approach shown in FIGS. 9A-9B may have several advantages. First, the use of a multi-piece coaxial waveguide structure 900 allows the structure to be divided into a long, but simple, outer boom portion 932 and a short, but complex, low pass filter portion 960. This may make it easier to control and achieve tight tolerances and concentricity. Moreover, implementing the low pass filter 962 using radially-inwardly extending ribs 964 that are formed on the inner surface of the outer waveguide 930 simplifies manufacturing, as it may be readily easy to machine the short low pass filter section as opposed to removing more substantial amounts of metal from the outside of the central waveguide.

Figure 10A:
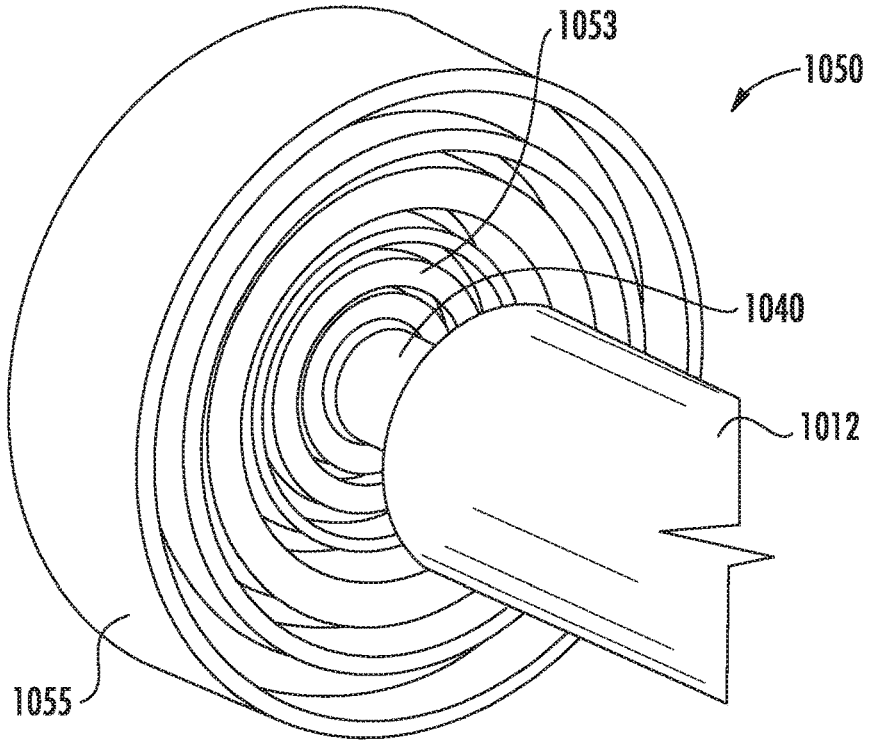
FIG. 10A is a perspective view of an end portion of a multi-piece dual-band hat feed waveguide structure according to embodiments of the present invention.
Figure 10B:
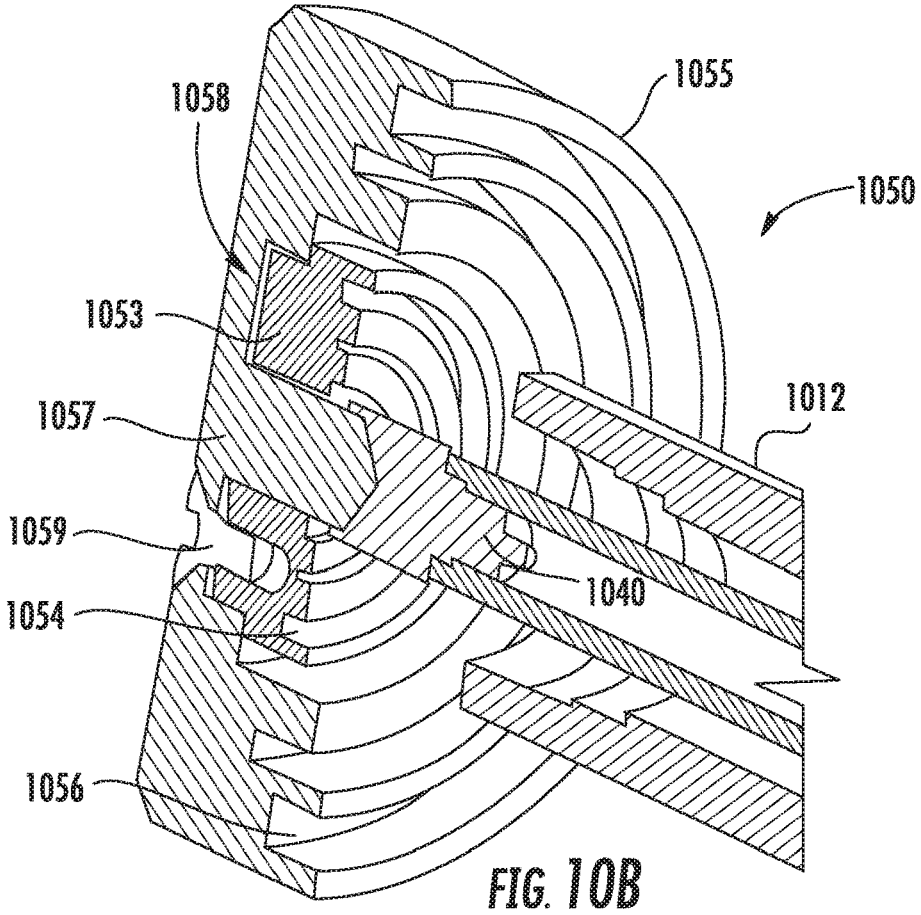
FIG. 10B is a cross-sectional view of the multi-piece dual-band hat feed waveguide structure of FIG. 10A.

FIGS. 10A-10B illustrate another example change that could be made to the dual-band parabolic reflector antennas described above. The change illustrated in FIGS. 10A-10B is made to the hat feed sub-reflector design included in, for example, the embodiments of FIGS. 2 and 5D-5E. FIG. 10A is a perspective view of an end portion of multi-piece dual-band hat feed 1050 waveguide structure that could be used in place of the hat feed structure of FIGS. 2 and 5D-5E, while FIG. 10B is a cross-sectional view of the multi-piece dual-band hat feed waveguide structure 1050.

Referring first to FIGS. 2 and 5D-5E, it can be seen that the hat feed sub-reflector may include inner grooves 154 and outer grooves 156. The inner grooves 154 are primarily designed to focus the high frequency signals, while the outer grooves 156 are primarily designed to focus the low frequency signals. The outer grooves 156 tend to be deeper and spaced further apart as compared to the inner grooves 154. It may be more difficult to manufacture the hat feed sub-reflector 150 as a single piece since one machine may be appropriate for forming the larger and more spaced-apart outer grooves 156 while a second machine may be better-suited to forming the smaller, more closely spaced inner grooves 154.

Referring now to FIGS. 10A-10B, it can be seen that the hat feed reflector 1050 may be mounted on the distal end of a coaxial waveguide structure 1012 via a dielectric support 1040. The coaxial waveguide structure 1012 and dielectric support 1040 may be identical to the above-discussed coaxial waveguide structure 112 and dielectric support 140, respectively, and hence further description thereof will be omitted.

As can also be seen in FIGS. 10A-10B, the hat feed reflector 1050 may be implemented as a multi piece structure. In the depicted embodiment, the hat feed reflector 1050 is a two piece structure, including a low-band feed portion 1055 that includes a plurality of outer grooves 1056 and a high-band feed portion 1053 that includes a plurality of inner grooves 1054. The inner grooves 1054 may be designed to primarily focus the high frequency signals, while the outer grooves 1056 may be designed to primarily focus the low frequency signals. The low-band feed portion 1055 may have the sub-reflector formed on a distal surface thereof. A proximal surface of the low-band feed portion 1055 may include the outer grooves 1056 and an annular central recess 1058. A post 1057 may extend through the annular central recess 1058. The high-band feed portion 1053 may be inserted onto the post 1057 and may fit within the annular central recess 1058 in the proximal surface of the low-band feed portion 1055. A proximal surface of the high-band feed portion 1053 may include the inner grooves 1054. Screws 1059 are used in the depicted embodiment to mount the high-band feed portion 1053 within the annular central recess 1058 of the low-band feed portion 1055. It will be appreciated, however, that any of a number attachment mechanisms could be used instead, such as glue, rivets, etc.

As can best be seen in FIG. 10B, the outer grooves 1056 tend to be thicker, deeper and/or spaced further apart as compared to the inner grooves 1054. As such, different tools may be better suited for forming the high-band feed portion 1053 and the low-band feed portion 1055. By implementing these feed portions 1053, 1055 as separate parts, appropriate tooling, different machine speeds and the like may be readily used for each piece and the manufacture of the hat feed reflector 1050 may be simplified.

While in the depicted embodiment, the inner grooves 1054 (which are designed to primarily focus the high frequency signals) are all provided on the high-band feed portion 1053, while the outer grooves 1056 (which are designed to primarily focus the low frequency signals) are all provide on the low-band feed portion 1055, this need not be the case. For example, in other embodiments the outermost of the inner grooves 1054 might be included on the low-band feed portion 1055 or the innermost of the outer grooves 1056 might be included on the high-band feed portion 1053. It will likewise be appreciated that more than two separate pieces may be used. For example, in further embodiments, the high-band feed portion 1053 could be implemented in two (or more) separate pieces and/or the low-band feed portion 1055 could be implemented in two (or more) separate pieces.

Pursuant to still further embodiments, a "coaxial" dielectric lens may be added to any of the antennas according to embodiments of the present invention. This dielectric lens may be used to control the radiating patterns in the low-band and high-band between the sub-reflector and the main parabolic reflector.

Figure 11A:
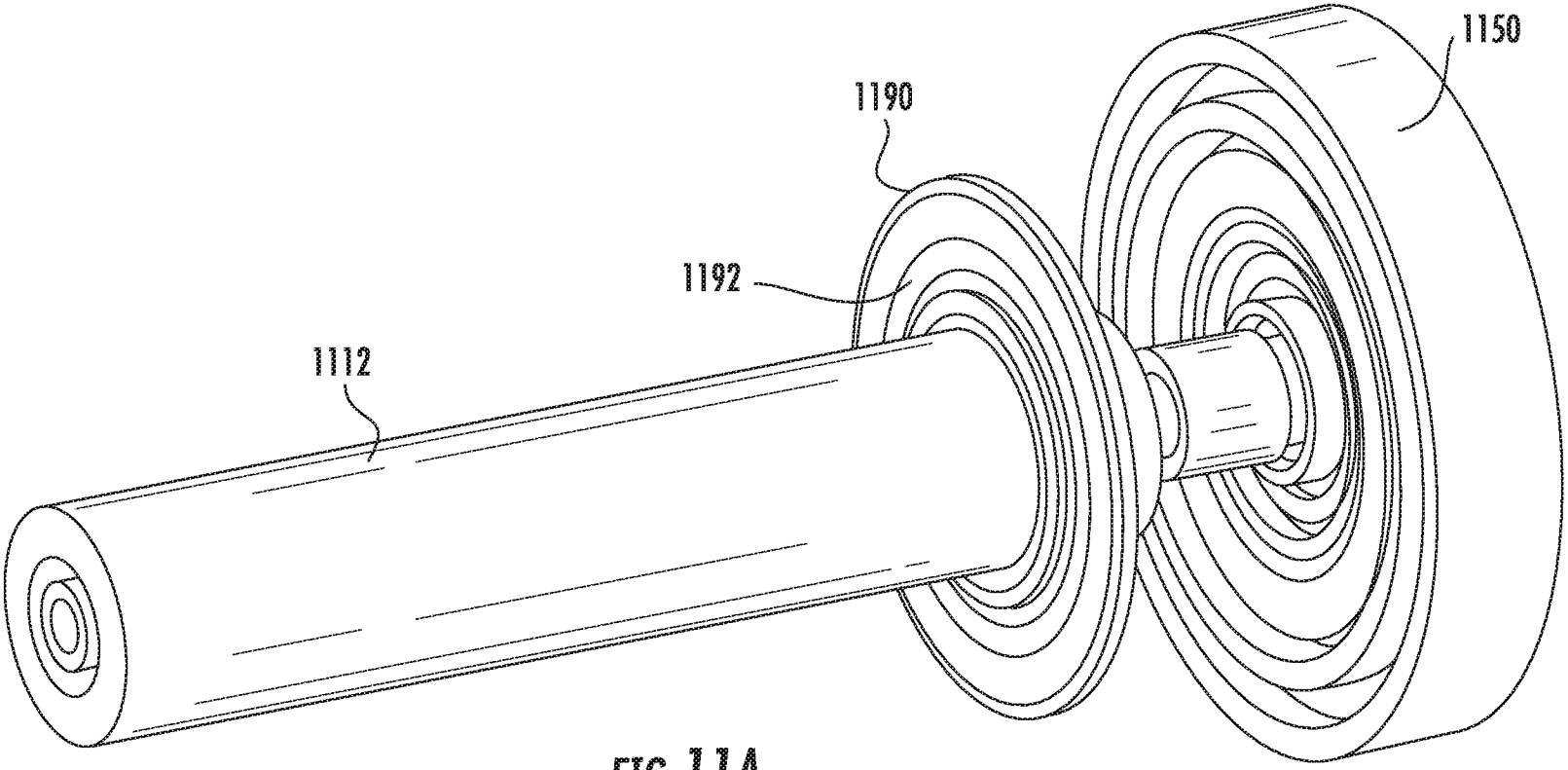
FIG. 11A is a perspective view of a coaxial waveguide structure according to embodiments of the present invention that includes a dielectric lens mounted thereon.
Figure 11B:
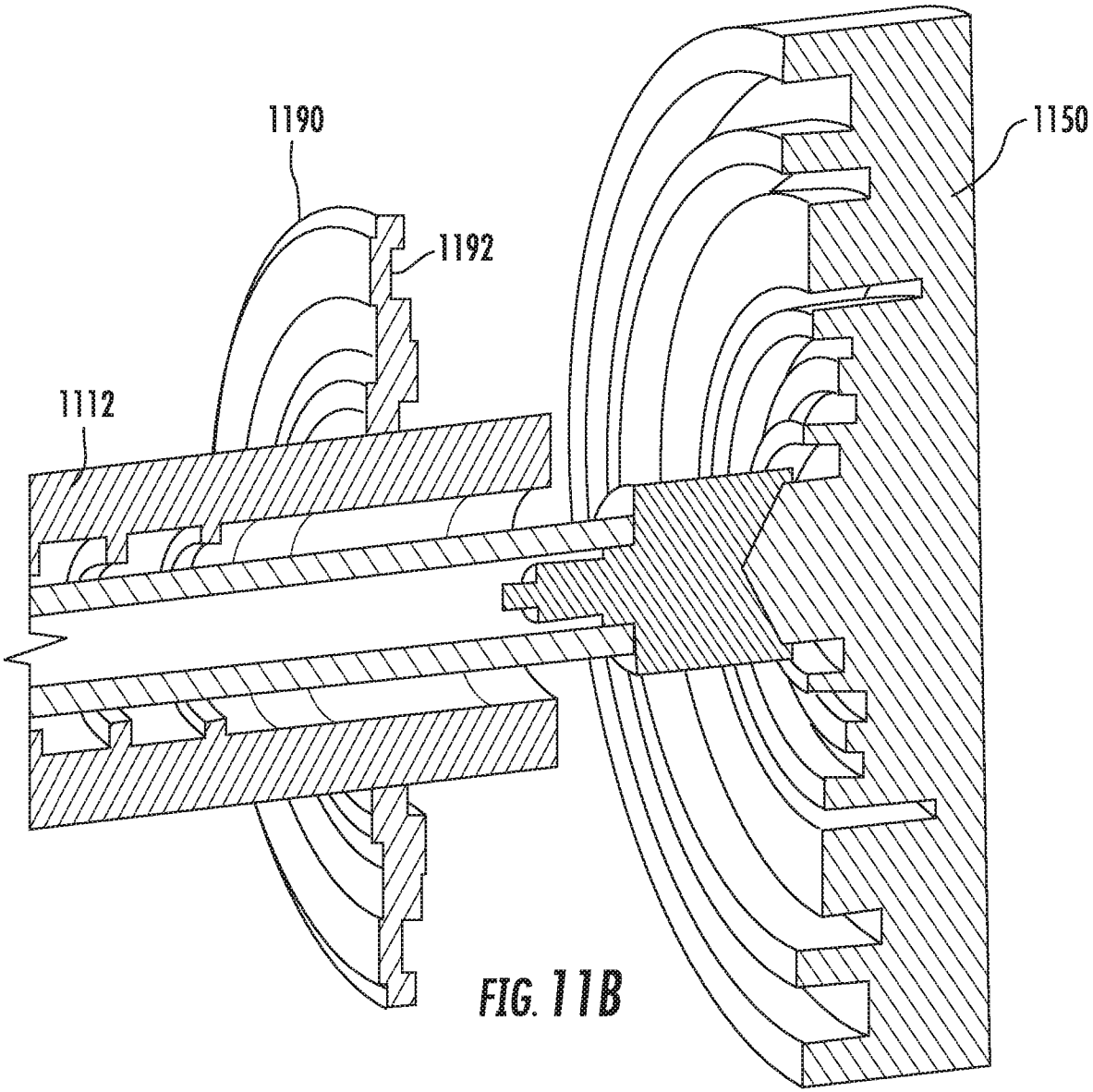
FIG. 11B is a cross-sectional view of an end portion of the coaxial waveguide structure and dielectric lens of FIG. 11A.

FIG. 11A is a perspective view of a coaxial waveguide structure 1112 according to embodiments of the present invention that includes a dielectric lens 1190 mounted thereon. FIG. 11B is a cross-sectional view of an end portion of the coaxial waveguide structure 1112 and dielectric lens 1190 of FIG. 11A.

As shown in FIGS. 11A-11B, the dielectric lens 1190 is mounted on the coaxial waveguide structure 1112 to be coaxial with the coaxial waveguide structure 1112. The dielectric lens 1190 may be mounted in relatively close proximity to the distal end of the coaxial waveguide structure 1112 in some embodiments. The dielectric lens 1190 may be formed of any suitable low-loss dielectric material such as, for example, Rexolite® or Laquerene. The dielectric lens 1190 may be formed by machining from a solid block, by molding or by any other appropriate process.

The dielectric lens 1190 may focus microwave energy incident thereon and/or may scatter/spread microwave energy incident thereon. Different portions of the dielectric lens 1190 may be designed to operate differently. The dielectric lens 1190 may be designed so that when the antenna is transmitting signals it controls the radiation that is passed from the sub-reflector 1150 to the main parabolic reflector (not shown) so that the radiation impinges on the main parabolic reflector in a desired manner (e.g., in a manner that produces a tightly focused antenna beam with little spillover of radiation outside the periphery of the main parabolic reflector and with little illumination of portions of the main parabolic reflector that are shielded by the sub-reflector 1150). When the antenna is receiving signals, the dielectric lens 1190 may control the radiation that is passed from the main parabolic reflector to the sub-reflector 1150 so that the radiation impinges on the sub-reflector 1150 in a desired manner (e.g., in a manner that focuses the radiation onto the sub-reflector 1150 in a manner that will efficiently pass the radiation to the coaxial waveguide structure 1112).

One issue that may occur with the dual-band parabolic reflector antennas according to embodiments of the present invention is that it may be difficult to design a feed structure that works well for both frequency bands. This may be particularly true when the two frequency bands are widely separated in frequency. The dielectric lens 1190 will operate differently on microwave signals in the two different frequency bands, as the effect of the dielectric lens 1190 on incident microwave energy is a function of the wavelength of the microwave signals. The dielectric lens 1190 may include concentric rings 1192 of material having different thicknesses that are provided by forming grooves in an annular disk of dielectric material. These concentric rings of different thickness may be used to shape the radiation patterns in the two different frequency bands. Thus, adding a dielectric lens 1190 provides another degree of freedom for designing the antenna to work well at both frequency bands.

The dielectric lens 1190 is different in a number of respects from prior art approaches for lensed antennas. As noted above, the dielectric lens 1190 is mounted on the coaxial waveguide structure 1112, and may be mounted to be coaxial and concentric with the coaxial waveguide structure 1112. Additionally, instead of operating on a signal that passes directly from the lens to a receive antenna through free space, the dielectric lens 1190 is mounted to operate on the microwave energy that is passing between the sub-reflector 1150 and the main parabolic reflector. Additionally, some portions of the dielectric lens 1190 may be designed to focus microwave energy, while other portions may be designed to spread the microwave energy incident thereon. Moreover, the dielectric lens 1190 design may be matched to the design of a hat feed structure or other structure that shapes energy that is passed from the feed boom of the antenna (e.g., the coaxial waveguide structure) to the sub-reflector 1150.

Figure 12A:
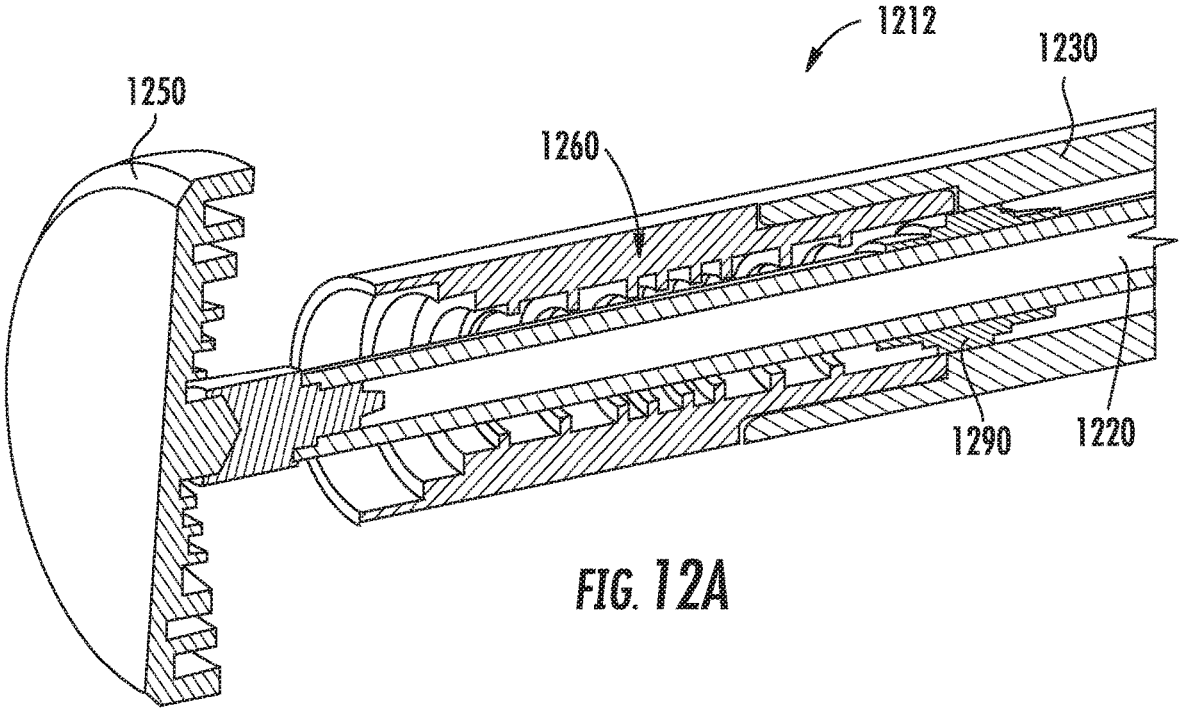
FIG. 12A is a perspective view of a dual-band hat feed waveguide structure according to embodiments of the present invention that includes a coaxial spacer.
Figure 12B:
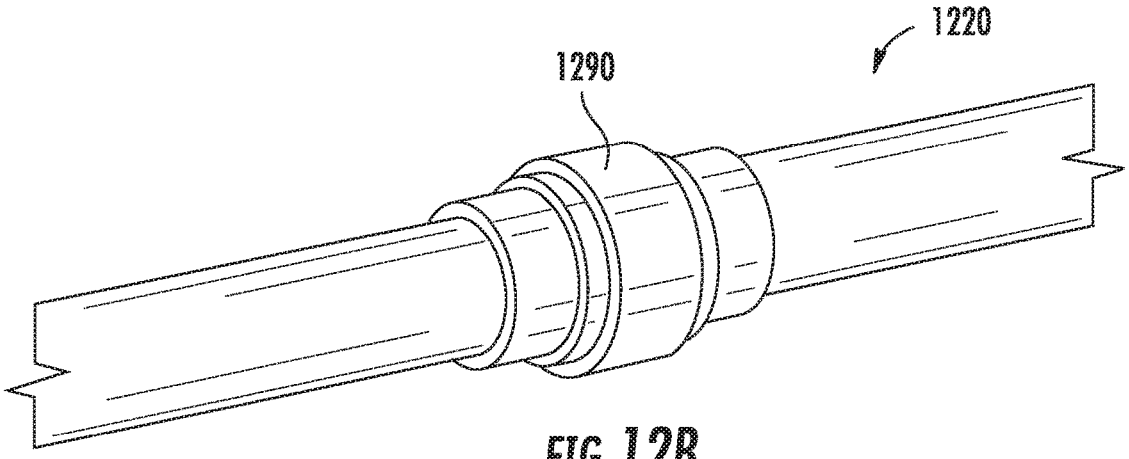
FIG. 12B is a perspective view of the central waveguide of the dual-band hat feed waveguide structure of FIG. 12A illustrating the coaxial spacer mounted thereon.

FIGS. 12A and 12B illustrate a coaxial spacer that may be included in any of the antennas according to embodiments of the present invention disclosed herein. In particular, FIG. 12A is a perspective view of a dual-band hat feed coaxial waveguide structure 1212 according to embodiments of the present invention that includes a coaxial spacer 1290, and FIG. 12B is a perspective view of the central waveguide of the dual-band hat feed waveguide structure 1212 of FIG. 12A illustrating how the coaxial spacer 1290 may be mounted thereon.

As discussed above, the coaxial waveguide structures according to embodiments of the present invention may include a central waveguide (e.g., central waveguide 1220 in FIGS. 12A-12B) and an outer waveguide (e.g., outer waveguide 1230 in FIGS. 12A-12B). To ensure proper operation of the antenna, it may be important to ensure that the central and outer waveguides 1220, 1230 remain concentric along their entire lengths. When the coaxial waveguide structure is relatively long and/or the hat feed (or other) assembly mounted on the distal end thereof is heavy, there may be a tendency for the coaxial waveguide structure to bend due to the effects of gravity. This may degrade the performance of the antenna.

As shown in FIGS. 12A-12B, pursuant to further embodiments of the present invention, one or more coaxial spacers 1290 may be inserted in between the outer surface of the central waveguide 1220 and the inner surface of the outer waveguide 1230. The coaxial spacers 1290 may be designed to be substantially transparent to microwave energy, at least within the operating frequency bands of the antenna. The coaxial spacers may have a stepped structure which may provide the transparency to the microwave signals. The coaxial spacers may be fabricated from a low loss dielectric material such as, for example, Rexolite® or Laquerene, and may be formed by any appropriate method including machining or molding.

In some embodiments, a single coaxial spacer 1290 may be provided. In other embodiments, multiple coaxial spacers may be provided, particularly with respect to longer coaxial waveguide structures 1212.

In the embodiment of FIGS. 12A-12B, the coaxial waveguide structure 1212 includes a low pass filter portion 1260. In this embodiment, the coaxial spacer 1290 is shown being located on the end of the filter portion 1260 that is opposite the sub-reflector 1250. In other embodiments, the coaxial spacer 1290 could be moved to the other end of the low pass filter portion 1260 at or near the distal end of the coaxial waveguide structure 1212. When located in this position, the coaxial spacer 1290 may also serve as a seal that may inhibit water or moisture ingress into the outer waveguide 1230.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated operations, elements, and/or components, but do not preclude the presence or addition of one or more other operations, elements, components, and/or groups thereof. As used herein, the term "and/or" includes any and all combinations of one or more of the associated listed items. Like reference numbers signify like elements throughout the description of the figures.

The thicknesses of elements in the drawings may be exaggerated for the sake of clarity. Further, it will be understood that when an element is referred to as being "on," "coupled to" or "connected to" another element, the element may be formed directly on, coupled to or connected to the other element, or there may be one or more intervening elements therebetween.

Terms such as "top," "bottom," "upper," "lower," "above," "below," and the like are used herein to describe the relative positions of elements or features. For example, when an upper part of a drawing is referred to as a "top" and a lower part of a drawing is referred to as a "bottom" for the sake of convenience, in practice, the "top" may also be called a "bottom" and the "bottom" may also be a "top" without departing from the teachings of the inventive concept.

It will be understood that, although the terms "first," "second," etc. may be used herein to describe various elements, these elements should not be limited by these terms. These terms are only used to distinguish one element from another. Thus, a first element could be termed a second element without departing from the teachings of the inventive concept.

The terminology used herein to describe embodiments of the invention is not intended to limit the scope of the inventive concept.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

The description of the present disclosure has been presented for purposes of illustration and, description, but is not intended to be exhaustive or limited to the disclosure in the form disclosed. Many modifications and variations will be apparent to those of ordinary skill in the art without departing from the scope and spirit of the disclosure. The aspects of the disclosure herein were chosen and described in order to best explain the principles of the disclosure and the practical application, and to enable others of ordinary skill in the art to understand the disclosure with various modifications as arc suited to the particular use contemplated.

What is claimed is:

1. A microwave antenna system, comprising:

a parabolic reflector antenna;

a dual-band feed assembly comprising a coaxial waveguide structure and a sub-reflector, wherein the coaxial waveguide structure includes a central waveguide and an outer waveguide that circumferentially surrounds the central waveguide; and a feed assembly interface that includes a first rectangular waveguide and a second rectangular waveguide that are each coupled to the outer waveguide at respective first and second longitudinal positions that are different from one another along opposite sides of the outer waveguide and are each configured to feed microwave signals into the outer waveguide, wherein the sub-reflector is mounted proximate a distal end of the coaxial waveguide structure, and wherein the feed assembly includes a dielectric feed that extends from a distal end of the central waveguide and a corrugated feed that extends from and circumferentially surrounds a distal end of the outer waveguide.

2. The microwave antenna system of claim 1, wherein a plurality of corrugations of the corrugated feed have a stepped profile.

3. The microwave antenna system of claim 1, wherein the sub-reflector is mounted using a support separate from the coaxial waveguide structure and is separated from the distal end of the central waveguide by a gap.

4. The microwave antenna system of claim 1, further comprising a low pass filter within the outer waveguide.

5. The microwave antenna system of claim 1, wherein the feed assembly interface comprises a power divider having at least first and second outputs that are coupled to the outer waveguide.

6. The microwave antenna system of claim 5, wherein the power divider comprises a Magic T power divider, and wherein the first and second outputs of the power divider are coupled to opposite sides of the outer waveguide.

7. The microwave antenna system of claim 1, wherein the feed assembly interface further comprises at least one shorting element disposed between the first and second longitudinal positions.

8. The microwave antenna system of claim 1, further comprising a polarization rotator that is disposed in the outer waveguide.

9. The microwave antenna system of claim 8, wherein the polarization rotator comprises at least one pin that is angled at a 45 degree angle with respect to a horizontal plane defined by a bottom of the first rectangular waveguide.

10. The microwave antenna system of claim 1, further comprising a coaxial spacer that is within the coaxial waveguide structure.

11. The microwave antenna system of claim 10, wherein the coaxial spacer seals a distal end of the outer waveguide.

12. The microwave antenna system of claim 4, wherein the low pass filter comprises a plurality of annular ridges that extend from an outer surface of the central waveguide into an interior of the outer waveguide.

13. The microwave antenna system of claim 4, wherein the low pass filter comprises a plurality of radially-inwardly extending ribs on an inner surface of the outer waveguide.

14. The microwave antenna system of claim 5, wherein each of the first and second outputs comprises a stepped channel that has decreasing cross-sectional area as the respective first and second outputs approach the outer waveguide.

15. The microwave antenna system of claim 10, wherein the coaxial spacer is positioned between an outer surface of the central waveguide and an inner surface of the outer waveguide.

16. A microwave antenna system, comprising:

a parabolic reflector antenna;

a dual-band feed assembly comprising a coaxial waveguide structure and a sub-reflector, wherein the coaxial waveguide structure includes a central waveguide and an outer waveguide that circumferentially surrounds the centralwaveguide; and a feed assembly interface that includes a first rectangular waveguide and a second rectangular waveguide that are each coupled along opposite sides of the outer waveguide at respective first and second longitudinal positions that are different from one another and are each configured to feed microwave signals into the outer waveguide, wherein the sub-reflector is mounted proximate a distal end of the coaxial waveguide structure, wherein the feed assembly includes a dielectric feed that extends from a distal end of the central waveguide and a corrugated feed that extends from and circumferentially surrounds a distal end of the outer waveguide, and wherein the feed assembly interface further comprises at least one shorting element.

17. The microwave antenna system of claim 1, further comprising:

a low pass filter, wherein the low pass filter is within the outer waveguide, and wherein the low pass filter comprises a plurality of annular ridges that extend from an outer surface of the central waveguide into an interior of the outer waveguide.

* * * * *